US012066034B2

(12) United States Patent
Glaves et al.

(10) Patent No.: US 12,066,034 B2
(45) Date of Patent: Aug. 20, 2024

(54) GROOVED SIDE LINER FOR CENTRIFUGAL PUMP

(71) Applicant: Weir Minerals Australia Ltd., Sydney (AU)

(72) Inventors: Garry Glaves, Eastwood (AU); Cesar Calma, Penshurst (AU)

(73) Assignee: WEIR MINERALS AUSTRALIA LTD. (AU)

( * ) Notice: Subject to any disclaimer, the term of this patent is extended or adjusted under 35 U.S.C. 154(b) by 0 days.

(21) Appl. No.: 18/031,343

(22) PCT Filed: Oct. 29, 2021

(86) PCT No.: PCT/AU2021/051264

§ 371 (c)(1),
(2) Date: Apr. 11, 2023

(87) PCT Pub. No.: WO2022/087675

PCT Pub. Date: May 5, 2022

(65) Prior Publication Data

US 2023/0375003 A1 Nov. 23, 2023

(30) Foreign Application Priority Data

Oct. 29, 2020 (AU) ..... 2020903927

(51) Int. Cl.
*F04D 29/42* (2006.01)
*F04D 7/04* (2006.01)

(52) U.S. Cl.
CPC ..... *F04D 29/4286* (2013.01); *F04D 7/04* (2013.01)

(58) Field of Classification Search
CPC ..... F04D 29/40; F04D 29/406; F04D 29/42; F04D 29/426; F04D 29/4286; F04D 7/04
See application file for complete search history.

(56) References Cited

U.S. PATENT DOCUMENTS

| | | | | |
|---|---|---|---|---|
| 3,447,475 | A | 6/1969 | Blum | |
| 6,139,260 | A | 10/2000 | Arbeus | |
| 9,835,168 | B2 | 12/2017 | Uchida et al. | |
| 2004/0146416 | A1 | 7/2004 | Burgess | |
| 2007/0274820 | A1 | 11/2007 | Lindskog | |
| 2012/0051897 | A1* | 3/2012 | Davis | F04D 29/167 415/196 |
| 2014/0030086 | A1 | 1/2014 | Staley et al. | |
| 2015/0345505 | A1* | 12/2015 | Uchida | E03F 5/26 415/196 |

(Continued)

FOREIGN PATENT DOCUMENTS

| | | | |
|---|---|---|---|
| CN | 206448956 | U | 8/2017 |
| CN | 108980050 | A1 | 12/2018 |
| EP | 1891331 | B1 | 1/2011 |

(Continued)

*Primary Examiner* — Elton K Wong
(74) *Attorney, Agent, or Firm* — Morriss O'Bryant Compagni Cannon, PLLC.

(57) ABSTRACT

Disclosed is side liner for a centrifugal pump. The side liner comprises an aperture for access to a central chamber of the centrifugal pump through the side liner. The side liner also comprises a plurality of grooves on a surface contacting material pumped by the centrifugal pump, the plurality of grooves extending radially from an inner edge of the surface, located near the aperture, to an outer edge.

13 Claims, 17 Drawing Sheets

(56) References Cited

U.S. PATENT DOCUMENTS

| | | | | | |
|---|---|---|---|---|---|
| 2023/0011208 | A1 * | 1/2023 | Tanaka | ..... | F04D 29/20 |

FOREIGN PATENT DOCUMENTS

| | | | | | |
|---|---|---|---|---|---|
| JP | S49108103 | U | 9/1974 | | |
| JP | H094585 | A | 1/1997 | | |
| JP | 2002115696 | A | 4/2002 | | |
| JP | 2005233170 | A | 9/2005 | | |
| KR | 20200037611 | A | 4/2020 | | |
| WO | WO-2019071318 | A1 * | 4/2019 | ..... | F04D 29/24 |

* cited by examiner

GROOVED SIDE LINER FOR CENTRIFUGAL PUMP

TECHNICAL FIELD

The present invention generally relates to the field of centrifugal pumps. More particularly, the present invention relates to a side liner for a centrifugal pump.

BACKGROUND

One form of centrifugal slurry pumps generally comprises an outer pump casing which encases a liner. The liner has a pumping chamber therein which may be of a volute, semi volute or concentric configuration, and is arranged to receive an impeller which is mounted for rotation within the pumping chamber. A drive shaft is operatively connected to the pump impeller for causing rotation thereof, the drive shaft entering the pump casing from one side. The pump further includes a pump inlet which is typically coaxial with respect to the drive shaft and located on the opposite side of the pump casing to the drive shaft. There is also a discharge outlet typically located at a periphery of the pump casing. The liner includes a main liner (sometimes referred to as the volute) and front and back side liners which are encased within the outer pump casing. The front side liner is often referred to as the front liner suction plate or throatbush. The back side liner is often referred to as the frame plate liner insert.

The impeller typically includes a hub to which the drive shaft is operatively connected, and at least one shroud. Pumping vanes are provided on one side of the shroud with discharge passageways between adjacent pumping vanes. The impeller may be of the closed type where two shrouds are provided with the pumping vanes being disposed therebetween. The shrouds are often referred to as the front shroud adjacent the pump inlet and the back shroud. The impeller may also be of the open face type which comprises one shroud only.

One of the major wear areas in the slurry pump is the front and back side liners. Slurry enters the impeller in the centre or eye, and is then flung out to the periphery of the impeller and into the pump casing. Because there is a pressure difference between the casing and the eye, there is a tendency for the slurry to try and migrate into a gap which is between the side liners and the impeller, resulting in high wear on the side liners.

As the slurry pump operates, the slurry is energized by rotary motion of the impeller. The slurry flows centrifugally and is collected by the main liner which directs the slurry towards the discharge outlet. Due to the main liner shape, the cut water area influences the flow pattern of recirculating slurry passing by. The side liners are in contact with the slurry within the cavity of the impeller shrouds. The proximity of the impeller outer shroud, or expeller vanes typical in the case of centrifugal slurry pumps, and the main liner cutwater to the frame plate liner may influence erosion rates endured by the side liners. In mill circuit duties, which are typically operated at low flow, erosion rates on the side liners is increased due to the increased rates of internal recirculation, which lead to the side liner eventually being a component with a short life span due to localized wear, sometimes referred to as "gouging".

In order to try and reduce wear in the region of the gap, it has been the practice for slurry pumps to have auxiliary or expelling vanes on the front shroud of the impeller. Auxiliary or expelling vanes may also be provided on the back shroud. The expelling vanes rotate the slurry in the gap creating a centrifugal field and thus reducing the driving pressure for the returning flow, reducing the flow velocity and thus the wear on the side liner. The purpose of these auxiliary vanes is to reduce flow re-circulation through the gap. These auxiliary vanes also reduce the influx of relatively large solid particles in this gap.

The reference in this specification to any prior publication (or information derived from the prior publication), or to any matter which is known, is not, and should not be taken as an acknowledgment or admission or any form of suggestion that the prior publication (or information derived from the prior publication) or known matter forms part of the common general knowledge in the field of endeavour to which this specification relates.

SUMMARY

This Summary is provided to introduce a selection of concepts in a simplified form that are further described below in the Detailed Description. This Summary is not intended to identify essential features of the claimed subject matter, nor is it intended to be used to limit the scope of the claimed subject matter.

In a first embodiment, there is provided by way of example a side liner for a centrifugal pump, the side liner comprising: an aperture for access to a central chamber of the centrifugal pump through the side liner; at least four grooves on a surface contacting material pumped by the centrifugal pump, the at least four grooves extending radially from an inner edge of the surface, located near the aperture, to an outer edge.

In one embodiment each groove of the at least four grooves is an arc with curvature in a direction opposite to a direction of curvature of a main pumping vane of an impeller of the centrifugal pump.

In one embodiment each groove of the at least four grooves is an arc with curvature in a same direction as a direction of curvature of a main pumping vane of an impeller of the centrifugal pump.

In one embodiment each groove of the at least four grooves is a straight line extending radially.

In one embodiment each groove of the at least four grooves is a radial straight line angled in a direction opposite to a direction of curvature of a main pumping vane of an impeller of the centrifugal pump.

In one embodiment each groove of the at least four grooves is a radial straight line angled in a same direction as a direction of curvature of a main pumping vane of an impeller of the centrifugal pump.

In one embodiment the curvature of the arc is in a parallel plane of the surface.

In one embodiment a depth of each of the at least four grooves varies over the surface.

In one embodiment the depth of each of the at least four grooves decreases towards the outer edge.

In one embodiment the depth of each of the at least four the groove decreases towards the inner edge.

In one embodiment the curvature of each of the at least four grooves is substantially similar to the curvature of the main pumping vane of the impeller.

In one embodiment a depth of each of the at least four grooves is deepest at a mid-region located between the outer edge and the inner edge of the surface.

In one embodiment a width of each of the at least four grooves is larger at a mid-region located between the outer edge and the inner edge of the surface.

In one embodiment each of the at least four grooves has a matching shape.

In one embodiment the at least four grooves are recessed grooves.

In one embodiment the at least four grooves are protruding grooves.

In one embodiment the at least four grooves includes recessed grooves and protruding grooves.

In one embodiment the side liner is a front side liner.

In one embodiment the aperture provides access for a slurry to the central chamber of the centrifugal pump.

In one embodiment the side liner is a back side liner.

In one embodiment the aperture provides access for a shaft for an impeller

In one embodiment the side liner has less than 100 grooves.

In one embodiment each of the at least four grooves have a depth of at least 10 mm.

In one embodiment, there is provided by way of example a centrifugal pump comprising: a side liner comprising: an aperture for access to a central chamber of the centrifugal pump through the side liner; at least four grooves on a surface contacting material pumped by the centrifugal pump, the at least four grooves extending radially from an inner edge of the surface, located near the aperture, to an outer edge.

In one embodiment the centrifugal pump comprises: a second side liner comprising: an aperture for access to the central chamber of the centrifugal pump through the second side liner; at least four grooves on a surface contacting material pumped by the centrifugal pump, the at least four grooves extending radially from an inner edge of the surface, located near the aperture of the second liner, to an outer edge.

In one embodiment the side liner is a back side liner and the second side liner is a front side liner.

In one embodiment each groove of the at least four grooves of the side liner is an arc with curvature in a direction opposite to a direction of curvature of a main pumping vane of an impeller of the centrifugal pump.

In one embodiment each groove of the at least four grooves of the side liner is an arc with curvature in a same direction as a direction of curvature of a main pumping vane of an impeller of the centrifugal pump.

In one embodiment each groove of the at least four grooves of the side liner is a straight line extending radially.

In one embodiment each groove of the at least four grooves of the side liner is a radial straight line angled in a direction opposite to a direction of curvature of a main pumping vane of an impeller of the centrifugal pump.

In one embodiment each groove of the at least four grooves of the side liner is a radial straight line angled in a same direction as a direction of curvature of a main pumping vane of an impeller of the centrifugal pump.

In one embodiment the curvature of the arc is in a parallel plane of the surface.

In one embodiment a depth of each groove of the at least four grooves of the side liner varies over the surface.

In one embodiment the depth of each groove of the at least four grooves is deepest at a mid-region located between the outer edge and the inner edge of the surface of the side liner.

In one embodiment the at least four grooves of the side liner are recessed grooves.

In one embodiment the side liner has less than 100 grooves.

In one embodiment the each of the at least four grooves have a depth of at least 10 mm.

BRIEF DESCRIPTION OF FIGURES

Example embodiments are provided in the following description, which is given by way of example only, of at least one preferred but non-limiting embodiment, described in connection with the accompanying figures.

DETAILED DESCRIPTION

The following modes, given by way of example only, are described in order to provide a more precise understanding of the subject matter of a preferred embodiment or embodiments.

Example Side Liner for a Centrifugal Pump

Described is a side liner for a centrifugal pump. When the side liner is installed in the centrifugal pump, the side liner may be in contact with material, such as slurry, pumped by the centrifugal pump. The side liner has an aperture for access to a central chamber of the centrifugal pump through the side liner. Located on the surface are a plurality of grooves extending radially from an inner edge of the surface, located near the aperture, to an outer edge. The side liner may also be installed as part of a centrifugal pump.

The side liner may be referred to as a patterned side liner for a centrifugal pump. The patterned side liner has a plurality of grooves on a surface of the side liner in contact with material pumped by the centrifugal pump. The grooves of the surface of the side liner may extend radially from near an inner edge of the surface, located near an aperture of the side liner, to an outer edge of the surface. The grooves of the side liner may have the shape of an arc with a direction of curvature being in an opposite direction to a direction of curvature of the main or auxiliary vanes on an impeller of the centrifugal pump.

Figure 1:
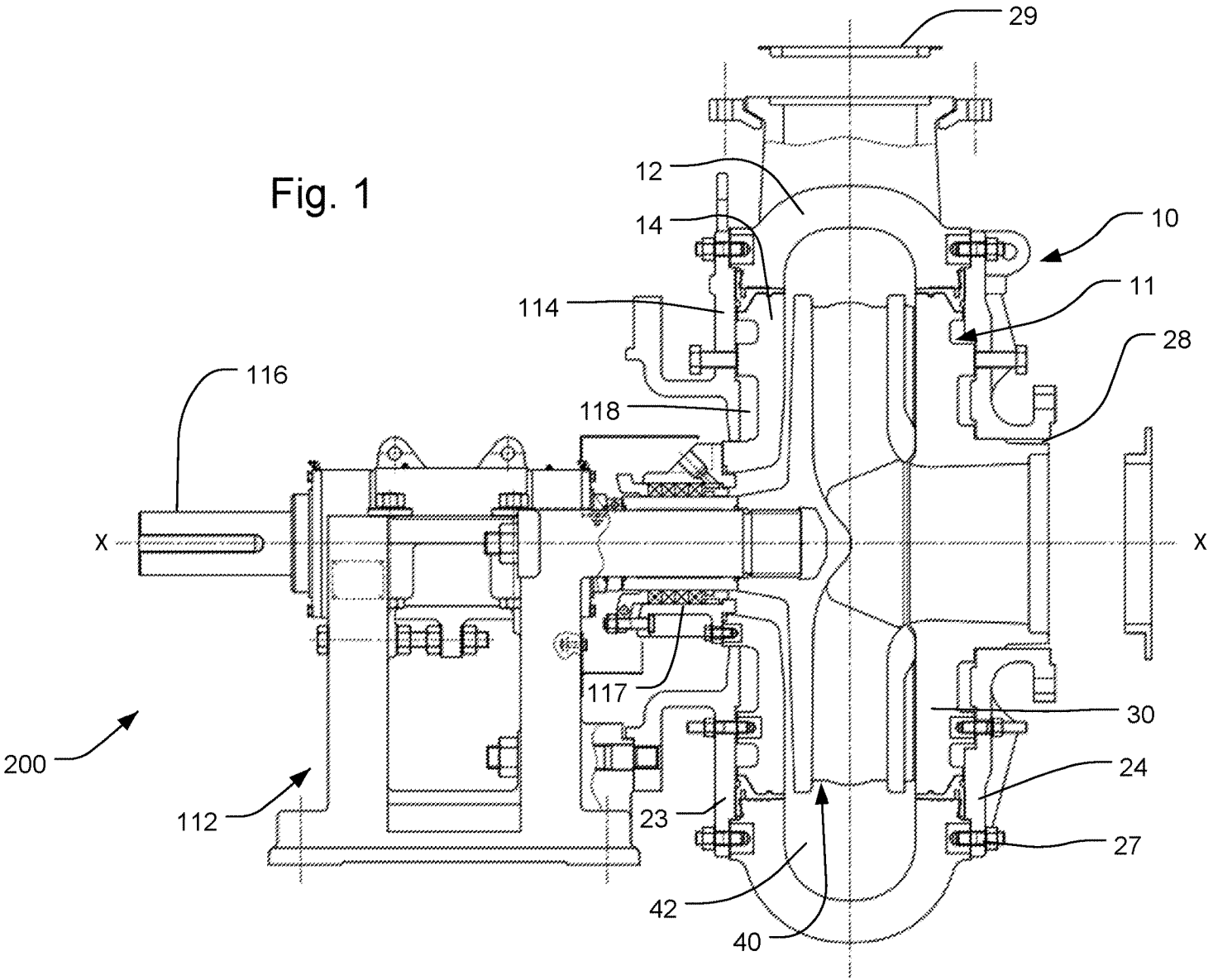
FIG. 1 is a schematic partial cross-sectional side elevation of one form of a pump apparatus according to one embodiment.

Referring in particular to FIG. 1 of the drawings, there is generally illustrated pump apparatus 200 comprising a pump 10 and pump housing support in the form of a pedestal or base 112 to which the pump 10 is mounted. Pedestals are also referred to in the pump industry as frames. The pump 10 generally comprises an outer casing that is formed from two side casing parts or sections 23, 24 (sometimes also known as the frame plate and the cover plate) which are joined together about the periphery of the two side casing sections 23, 24. The pump 10 is formed with side openings one of which is an inlet hole 28 there further being a discharge outlet hole 29 and, when in use in a process plant, the pump is connected by piping to the inlet hole 28 and to the outlet hole 29, for example to facilitate pumping of a mineral slurry.

Figure 2:
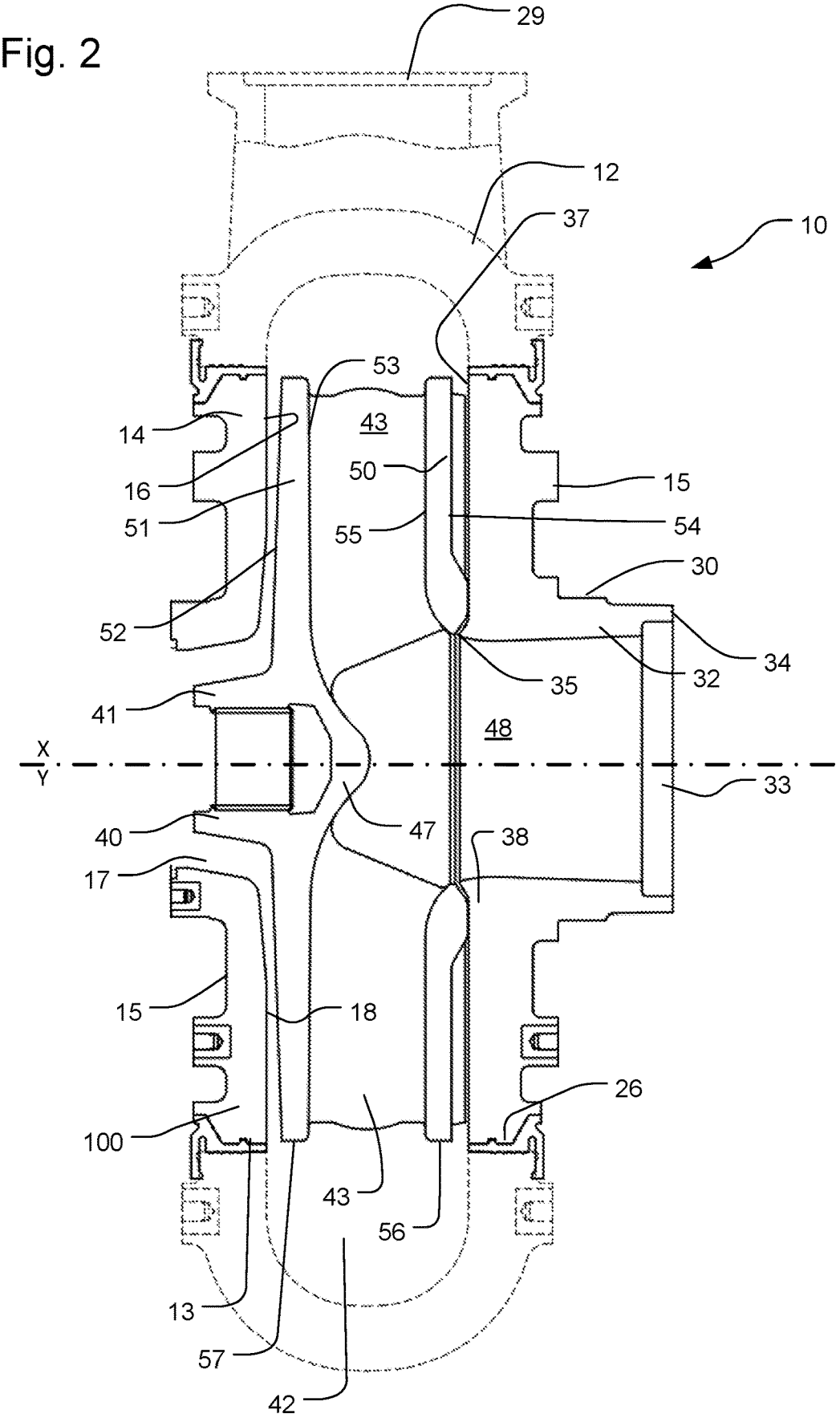
FIG. 2 is a more detailed schematic partial cross-sectional side elevation of part of the pump apparatus of FIG. 1.

The pump 10 further comprises a pump inner liner 11 arranged within the outer casing and which includes a main liner 12 and two side liners 14, 30. The side liner 14 is located nearer the rear end of the pump 10 (that is, nearest to the pedestal or base 112), and the other side liner (or front liner) 30 is located nearer the front end of the pump and inlet hole 28. The side liner 14 is also referred to as the back side part or frame plate liner insert and the side liner 30 is also referred to as the front side part or throatbush. The main liner comprises two side openings therein. As shown in FIG. 2 the back side liner 14 comprises a disc like main body 100 having an inner edge 17 and an outer edge 13. The main body 100 has a first side 15 and a second side 18 with a side surface 16.

As shown in FIG. 1 the two side casing parts 23, 24 of the outer casing are joined together by bolts 27 located about the periphery of the casing parts 23, 24 when the pump is assembled for use. In some embodiments the main liner 12 can also be comprised of two separate parts which are assembled within each of the side casing parts 23, 24 and brought together to form a single main liner, although in the example shown in FIG. 1 the main liner 12 is made in one-piece, shaped similar to a car tyre. The liner 11 may be made of materials such as rubber, elastomer or of metal.

When the pump is assembled, the side openings in the main liner 12 are filled by or receive the two side liners 14, 30 to form a continuously-lined pumping chamber 42 disposed within the pump outer casing. A seal chamber housing 114 encloses the side liner (or back side part) 14 and is arranged to seal the space or chamber 118 between drive shaft 116 and the pedestal or base 112 to prevent leakage from the back area of the outer casing. The seal chamber housing takes the form of a circular disc section and an annular section with a central bore, and is known in one arrangement as a stuffing box 117. The stuffing box 117 is arranged adjacent to the side liner 14 and extends between the pedestal 112 and a shaft sleeve and packing that surrounds drive shaft 116.

As shown in FIGS. 1 and 2 an impeller 40 is positioned within the main liner 12 and is mounted or operatively connected to the drive shaft 116 which is adapted to rotate about a rotation axis X-X. A motor drive (not shown) is normally attached by pulleys to an exposed end of the shaft 116, in the region behind the pedestal or base 112. The rotation of the impeller 40 causes the fluid (or solid-liquid mixture) being pumped to pass from a pipe which is connected to the inlet hole through the pumping chamber 42 which is within the main liner 12 and the side liners 14, 30 and then out of the pump via the discharge outlet hole.

The impeller 40 includes a hub 41 from which a plurality of circumferentially spaced pumping vanes 43 extend. An eye portion 47 extends forwardly from the hub 41 towards a passage 33 in the front liner 30. The impeller 40 further includes a front shroud 50 and a back shroud 51, the vanes 43 being disposed and extending therebetween and an impeller inlet 48. The hub 41 extends through a hole, formed by the inner edge 17 of the back liner 14.

The impeller front shroud 50 includes an inner face 55, an outer face 54 and a peripheral edge portion 56. The back shroud 51 includes an inner face 53, an outer face 52 and a peripheral edge portion 57. The front shroud 50 includes the inlet 48, being the impeller inlet and the vanes 43 extend between the inner faces of the shrouds 50, 51. The shrouds are generally circular or disc-shaped when viewed in elevation; that is in the direction of rotation axis X-X.

Each impeller shroud may have a plurality of auxiliary or expelling vanes on the outer faces 52, 54 thereof. Auxiliary vanes are an optional feature of the impeller that will be described in more detail in relation to FIG. 3 and FIG. 4 below.

The front side liner 30 has a cylindrically shaped inlet section 32 leading from an outermost end 34 to an innermost end 35. When the pump 10 is in operation, the outermost end 34 may be connected to a feed pipe, not shown, through which slurry is fed to the pump 10. The innermost end 35 has a raised lip 38 which is arranged in a close facing relationship with the impeller 40 when in an assembled position. The front side liners 30 has a surface 37, facing in towards the pumping chamber 42, which is in contact with the pump 10 during pump operation as well as an outer edge 26.

Figure 3:
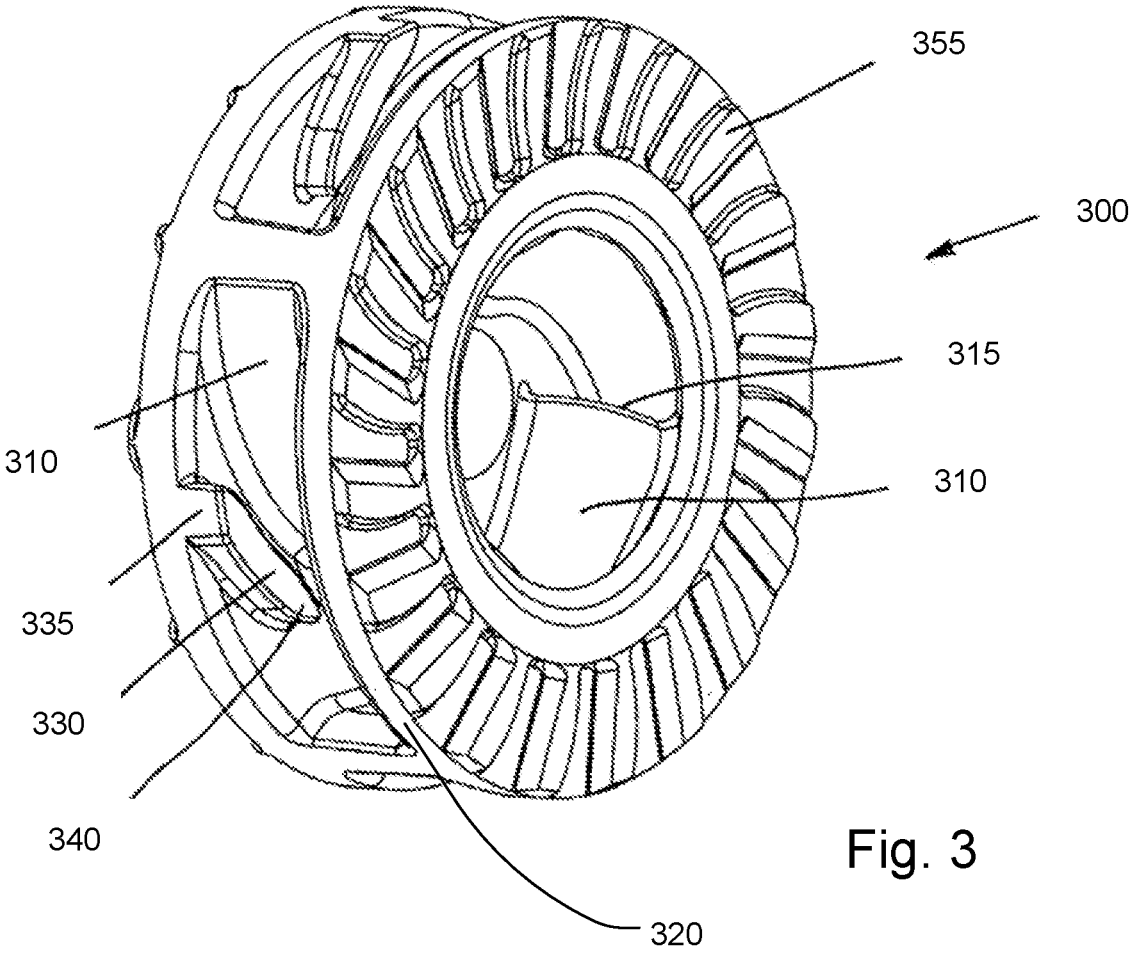
FIG. 3 is a view of an impeller according to one embodiment.
Figure 4:
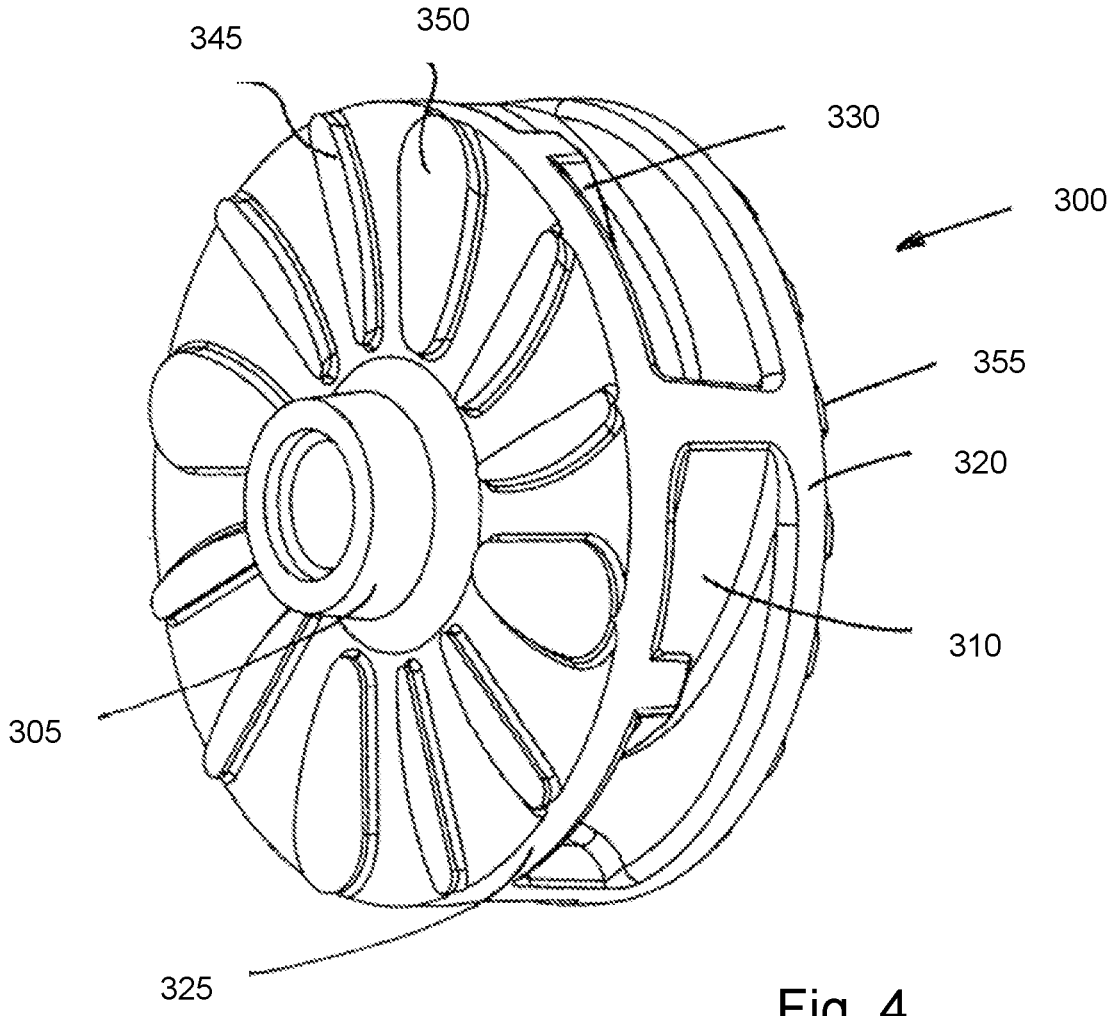
FIG. 4 is an alternative view of the impeller of FIG. 3.

An example impeller, as may be used in pump 10, will now be described with reference to FIG. 3 and FIG. 4. FIG. 3 shows an impeller 300 as viewed from a pump inlet side with a view of a front shroud 320. FIG. 4 shows the impeller 300 as viewed from a drive shaft inlet side with a view of a back shroud 325. That is, FIG. 3 and FIG. 4 show the impeller 300 from opposite sides.

The pump inlet is coaxial with respect to a drive shaft and is located on the opposite side of the pump casing to the drive shaft. The drive shaft attaches to the impeller 300 through a hub 305. The impeller 300 has circumferentially spaced pumping vanes 310 with a leading edge 315. The circumferentially spaced pumping vanes 310 take slurry from a pumping chamber of a centrifugal pump and pump the slurry away from the pumping chamber. Located between the circumferentially spaced pumping vanes 310 are projections 330 in the form of elongate, flat-topped projections. The projections 330 have an outer end 335 located adjacent to the outer peripheral edge of the back shroud 325 as well as an inner end 340 located approximately midway of a passageway formed from the circumferentially spaced pumping vanes 310.

Located on each face of the impeller 300 are auxiliary vanes. Auxiliary vanes 345 and auxiliary vanes 350 are located on a back side surface of the impeller 300, that being the surface closest to a back side liner of the pump. Auxiliary vanes 355 are located on a front side surface of the impeller 300, that being the surface closest to a front side liner of the pump. The circumferentially spaced pumping vanes 310 are normally referred to as backwards-curving vanes when viewed with a direction of rotation of the impeller 300. The auxiliary vanes, such as auxiliary vanes 345, auxiliary vanes 350 and auxiliary vanes 355 are also curved, to varying degrees, and are shown with curvature in the same direction as the circumferentially spaced pumping vanes 310. The auxiliary vanes may be considered to backwards-curving, similar to the circumferentially spaced pumping vanes 310.

Figure 5A:
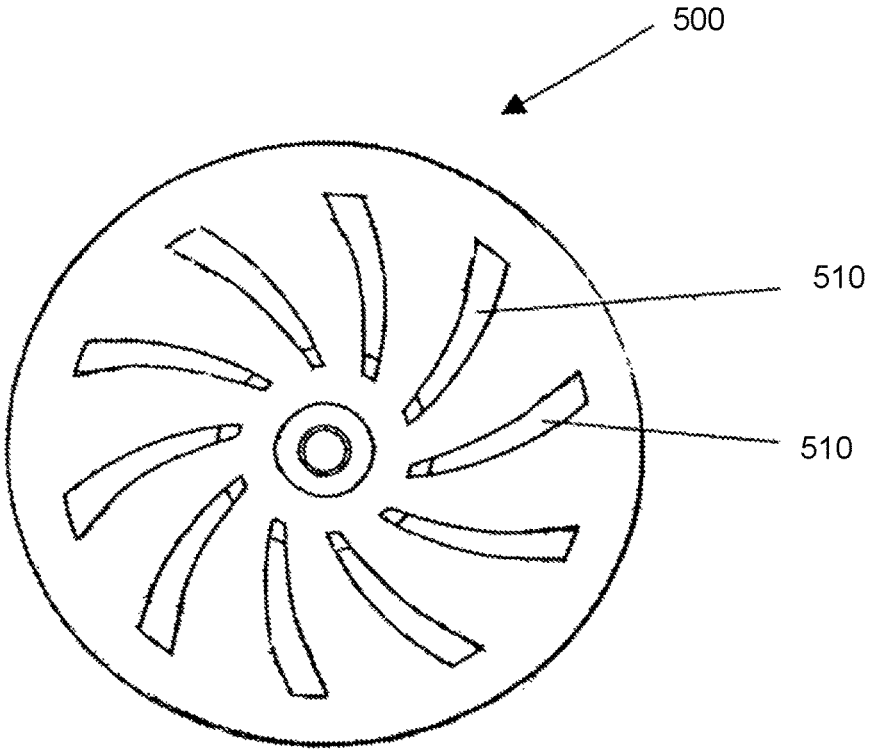
FIGS. 5A and B are alternative auxiliary vanes for an impeller according to one embodiment.
Figure 5B:
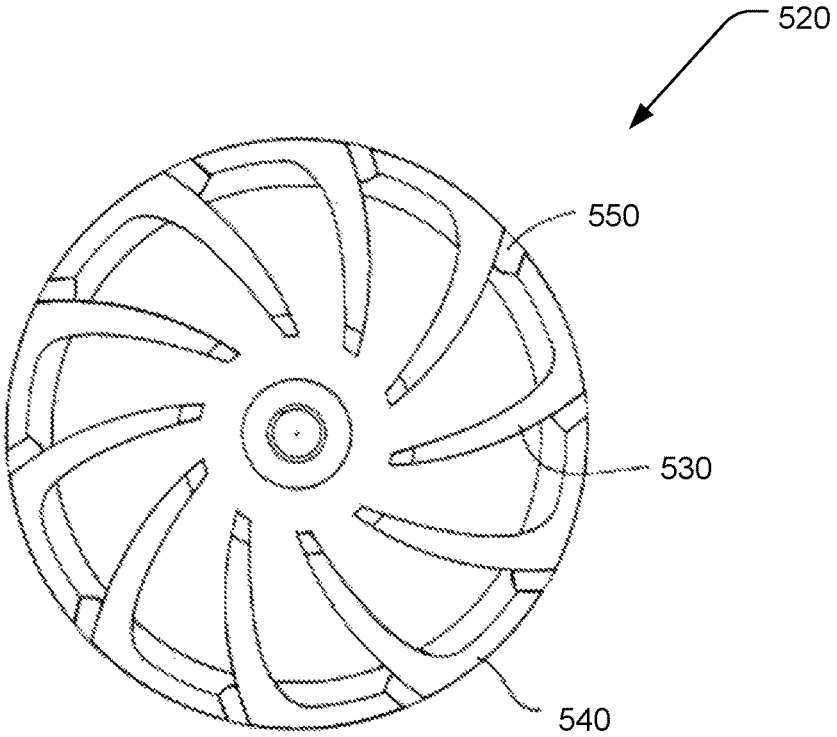

FIGS. 5A and B show alternative designs for auxiliary vanes on a back side surface of an impeller. Impeller 500 has a plurality of evenly spaced vanes 510. Impeller 520 also has a plurality of evenly spaced vanes 530. However, the vanes 530 extend to annular projections 540 located at an edge of the surface of the impeller 520. The annular projections 540 have passages 550 to allow for slurry in the pump to flow past the annular projections 540. Both the vanes 510 and the vanes 530 are backwards-curving vanes when viewed with a direction of rotation of the impeller 500 or the impeller 520.

Although the auxiliary vanes of impeller 300, impeller 500 and impeller 520 have varying designs, they may assist in pumping slurry in a centrifugal pump. The auxiliary vanes may work in conjunction with other vanes, such as circumferentially spaced pumping vanes 310 of impeller 300 to move slurry from the inlet of the centrifugal pump to an outlet. However, as the slurry moves inside the centrifugal pump the slurry may cause the front, side and main liners to wear away. Alternatively, a centrifugal pump may use an impeller without auxiliary vanes, relying on the main vanes to move slurry in the pump.

A side liner will now be described in relation to FIG. 6A which shows a patterned side liner 600, more specifically a back side liner having a radially swirling pattern for use in a centrifugal pump such as pump 10. As discussed above, the radially swirling pattern on the side liner 600 may reduce localised wear on the side liner, compared to a flat surfaced side liner. The decreased wear may increase an operational lifespan of the patterned side liner. Typically, a side liner such as the side liner 600 is a replaceable part in a centrifugal pump made out of a suitable material such as rubber, elastomer or metal. The side liner 600 operates in a manner similar to the side liner 14 of FIG. 1.

The side liner 600 has a centrally located aperture 610. The aperture 610 allows passage of a shaft into a pumping chamber of a centrifugal pump to rotate an impeller, such as the impeller 40 or the impeller 300 described above. The side liner 600 has a surface 615 that is placed facing towards the pumping chamber and may be in contact with slurry pumped by the centrifugal pump. The surface 615 has an inner edge 620, that forms an edge of the aperture 610 and seals with the drive shaft, such as the drive shaft 116 described above. An outer edge 630 of the surface 615 may form a seal with a main liner, such as main liner 12 described above.

Located on the surface 615 are a plurality of grooves 640. The grooves 640 are formed into the surface 615 and may extend radially from the inner edge 620 to the outer edge 630, as shown in FIG. 6A. The grooves 640 may be considered to be in a plane parallel to the surface 615. The grooves 640 may have a cross section that will be described in more detail in relation to FIGS. 10A to E below. Depth of the grooves 640 may vary over the surface 615. One example of a depth profile for the grooves 640 is for the grooves 640 to be shallower closer the inner edge 620 and the outer edge 630. With such a depth profile a deepest part of the grooves 640 may be located at, or near, a mid-region 650 located between the inner edge 620 and the outer edge 630. The depth profile of the grooves 640 may vary in different ways as will be explained below in relation to FIGS. 9A to D.

Figure 6A:
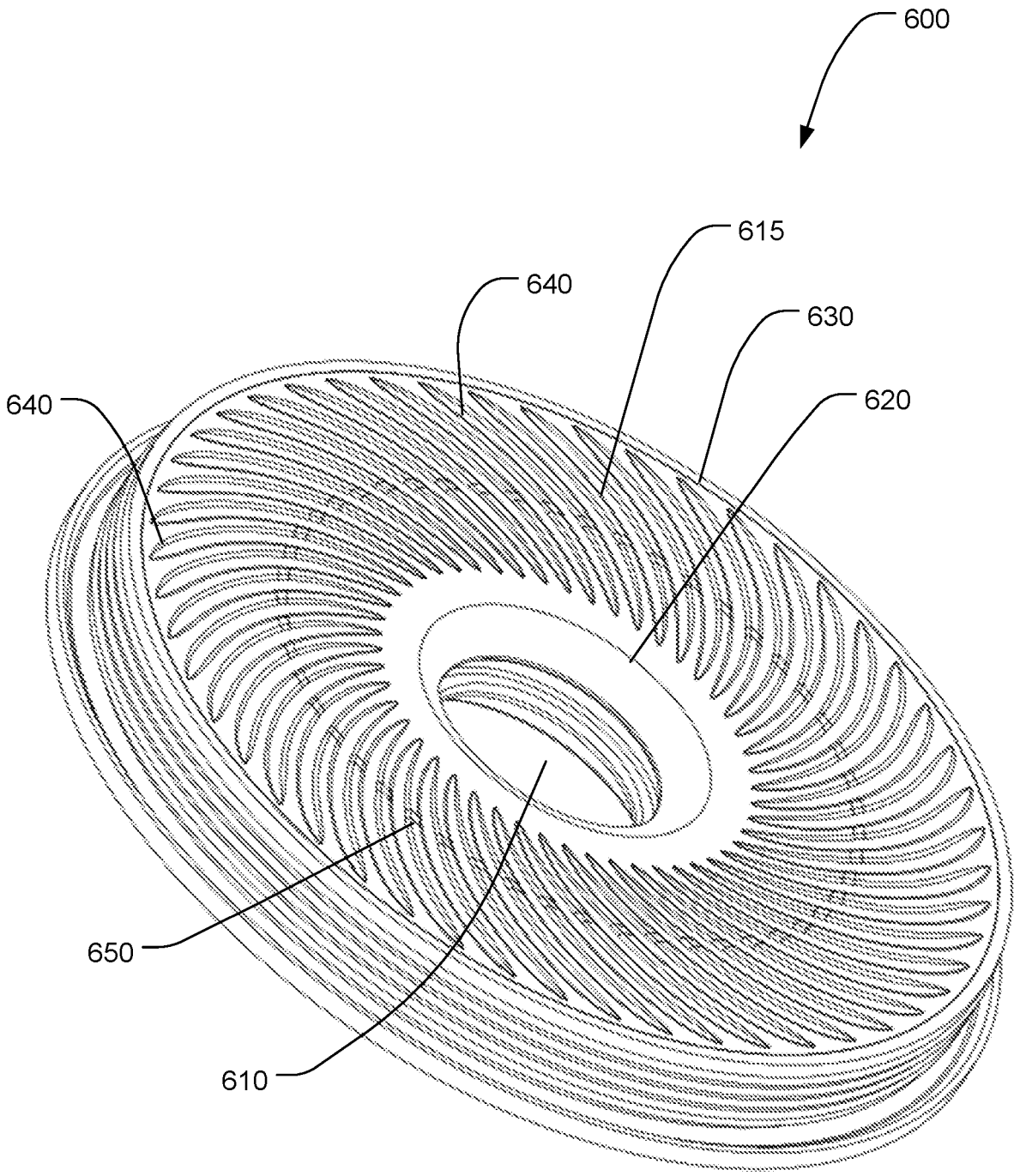
FIG. 6A illustrates a side liner with curved grooves according to one embodiment.

The grooves 640 of FIG. 6A are not straight lines, but are arced or curved. The direction of curvature of the arc may play a role in reducing gouging of the side liner 600. The grooves 640 are formed in an arc with curvature in a direction opposite to a direction of curvature of the main pumping vanes of the impeller of the centrifugal pump. The curvature of the grooves 640 is also in a direction opposite to curvature of the auxiliary vanes of the impeller, if auxiliary vanes are fitted. As a result, the direction of the curvature will differ between the front and the back side liners, when looking at the grooved surface of the liners. The front and side liners have grooves that may be referred to as forwards-curving grooves when viewed with a direction of rotation of the impeller, as compared to the backward-curving vanes of the impeller.

Figure 6B:
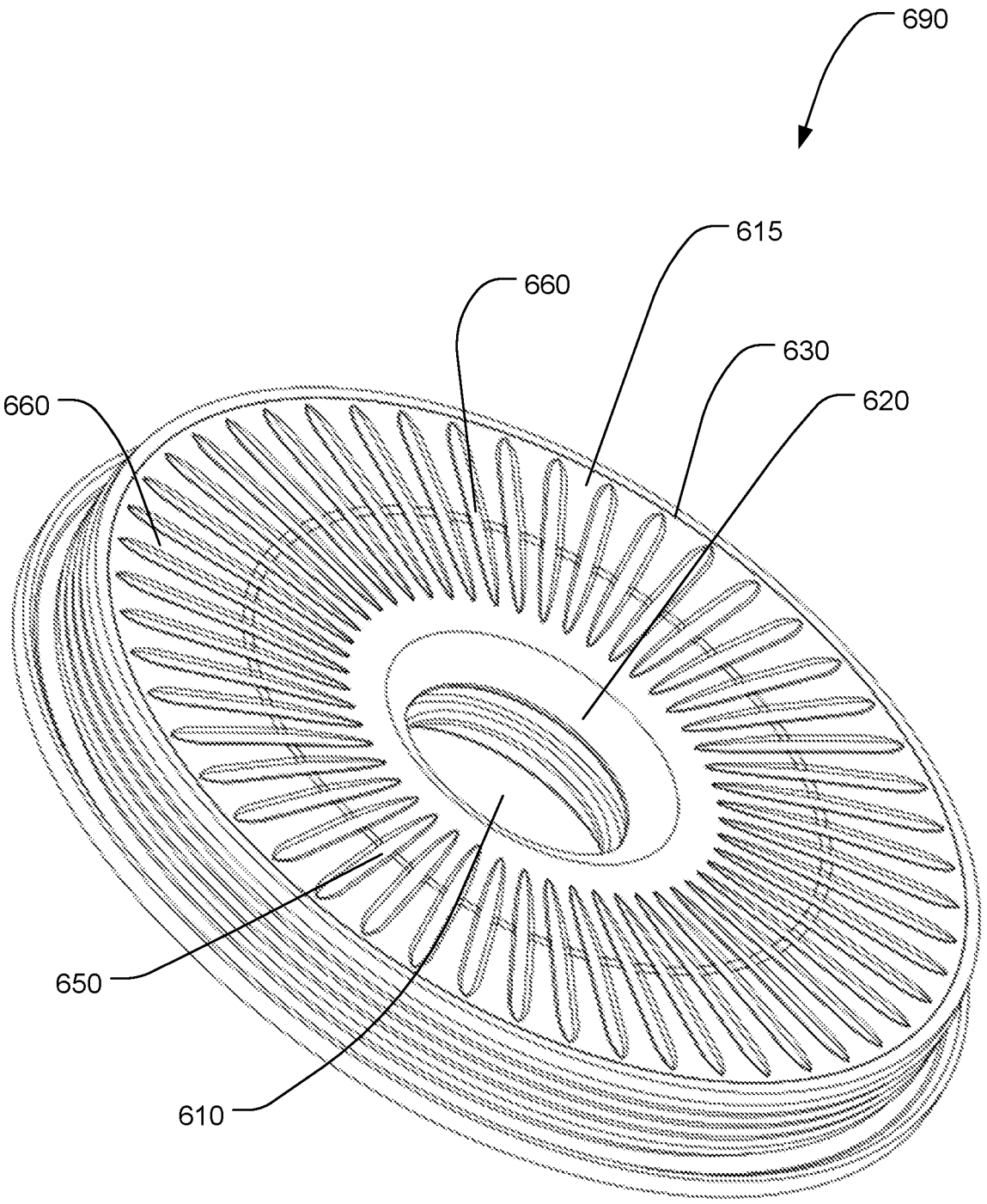
FIG. 6B illustrates a side liner with straight radial grooves according to one embodiment.

A side liner will now be described in relation to FIG. 6B which shows a radial groove side liner 690 with grooves 660 extending radially, in a straight line, from the inner edge 620 to the outer edge 630. The radial groove side liner 690 is similar to the side liner 600 described above in relation to FIG. 6A, except that the radial groove side liner 690 has an alternative groove pattern. As with the side liner 600, the radial groove side liner 690 may be used in a centrifugal pump such as pump 10. The pattern on the radial groove side liner 690 may reduce localised wear on the side liner, compared to a flat surfaced side liner. The decreased wear may increase an operational lifespan of the patterned side liner. Typically, a side liner such as the radial groove side liner 690 is a replaceable part in a centrifugal pump made out of a suitable material such as rubber, elastomer or metal. The radial groove side liner 690 operates in a manner similar to the side liner 14 of FIG. 1 and the side liner 600.

A side liner will now be described in relation to FIG. 6C which shows an angled radial groove side liner 695 with grooves 670 extending radially, but angled or slanted, from the inner edge 620 to the outer edge 630. That is, the angled radial groove side liner 695 has angled radial grooves or slanted radial grooves when compared to the purely radial grooves 660 of radial groove side liner 690. The angled radial groove side liner 695 is an similar to the side liner 600 or radial groove side liner 690 described above, except the angled radial groove side liner 695 has an alternative groove pattern. As with the side liner 600 and the radial groove side liner 690, the angled radial groove side liner 695 may be used in a centrifugal pump such as pump 10. The pattern on the angled radial groove side liner radial 695 may reduce localised wear on the side liner, compared to a flat surfaced side liner. The decreased wear may increase an operational lifespan of the patterned side liner. Typically, a side liner such as the angled radial groove side liner 695 is a replaceable part in a centrifugal pump made out of a suitable material such as rubber, elastomer or metal. The angled radial groove side liner 695 operates in a manner similar to the side liner 14 of FIG. 1, the side liner 600 and the radial groove side liner 690.

Figure 6C:
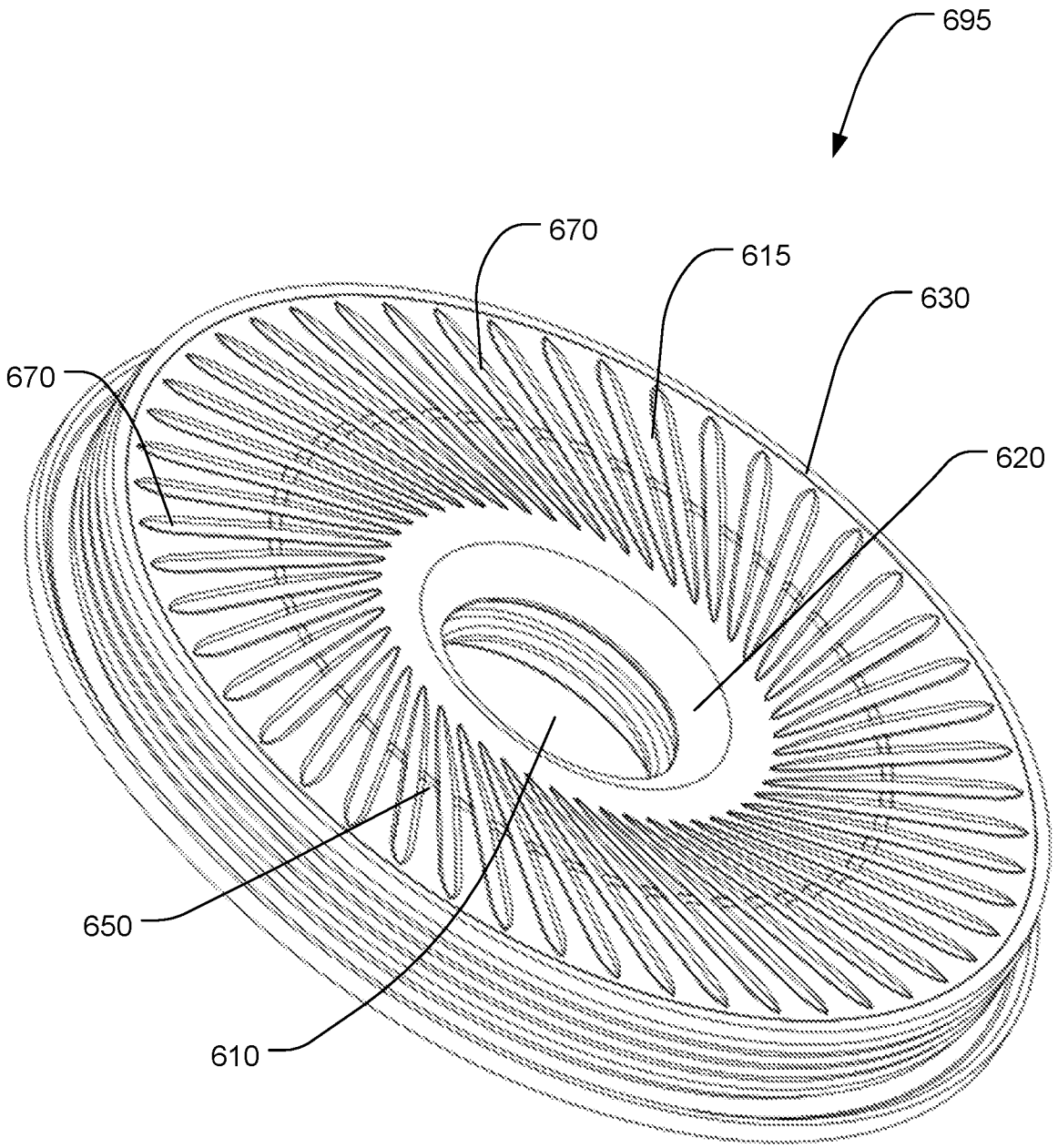
FIG. 6C illustrates a side liner with straight, angled radial grooves according to one embodiment.

The angled radial groove side liner 695 shown in FIG. 6C has grooves 670 angled in a same direction as the curves of the grooves 640 of the side liner 600. That is, the grooves 670 are angled in a direction opposite to the direction of curvature of the main pumping vanes of the impeller of the centrifugal pump. In an alternative embodiment, the grooves 670 may be angled in a same direction as the curvature of the main pumping vanes of the impeller.

Figure 7:
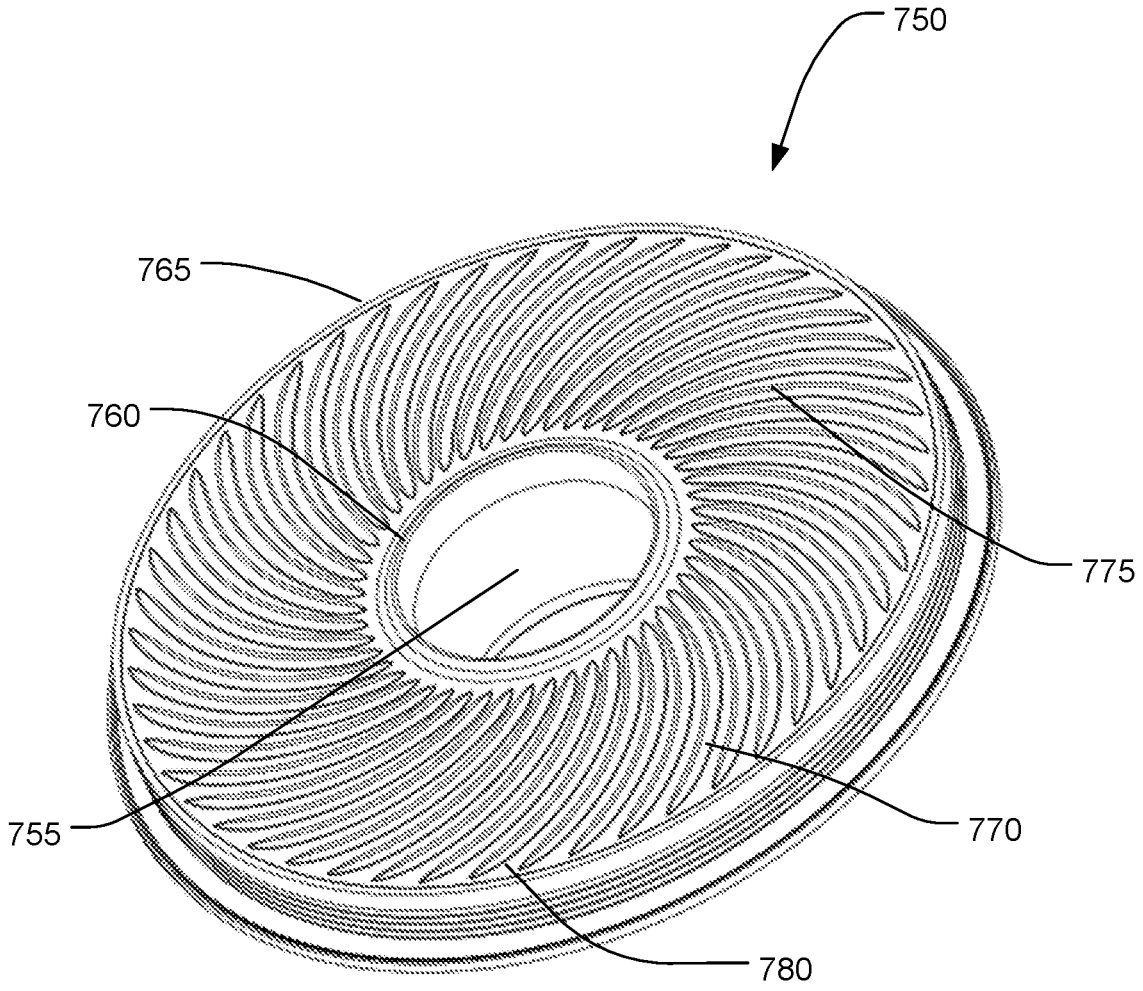
FIG. 7 illustrate a back side liner with curved grooves according to one embodiment.

A front side liner featuring a radial swirling pattern of curved grooves, will be described in relation to FIG. 7 which shows a front side liner 750 that may be used in a centrifugal pump such as pump 10. The front side liner 750 has an aperture 755 that allows slurry to enter a pumping chamber of the centrifugal pump. A surface 780 extends from the inner edge 760 to an outer edge 765. The surface 780 may be in contact with slurry in the pumping chamber when the front side liner 750 is installed in the operating centrifugal pump. The surface 780 has a plurality of recessed, radial, grooves 770 that are arc shaped and travel from the inner edge 760 to the outer edge 765. The curvature of the arc is in a direction opposite to curvature of vanes or auxiliary vanes of an impeller of the centrifugal pump. The direction of the curvature of the grooves 770 is in an opposite direction to the grooves 640 of the side liner 600 of FIG. 6A as the front side liner 750 is on an opposite side of the impeller. A depth of the plurality of grooves 770 may vary over the surface 780 with a deepest part of the grooves 770 being at a mid-region 775. In an alternative embodiment the grooves 770 may curve in the same direction as the curvature of the vanes of the impeller. Alternatively, the front side liner 750 may have other groove patterns, such as the straight radial groove pattern of the radial groove side liner 690, the angled radial groove pattern of the angled radial groove side liner 695 or angled radial groove pattern angled in a same direction as the curvature of the main pumping vanes of the impeller.

Figure 8:
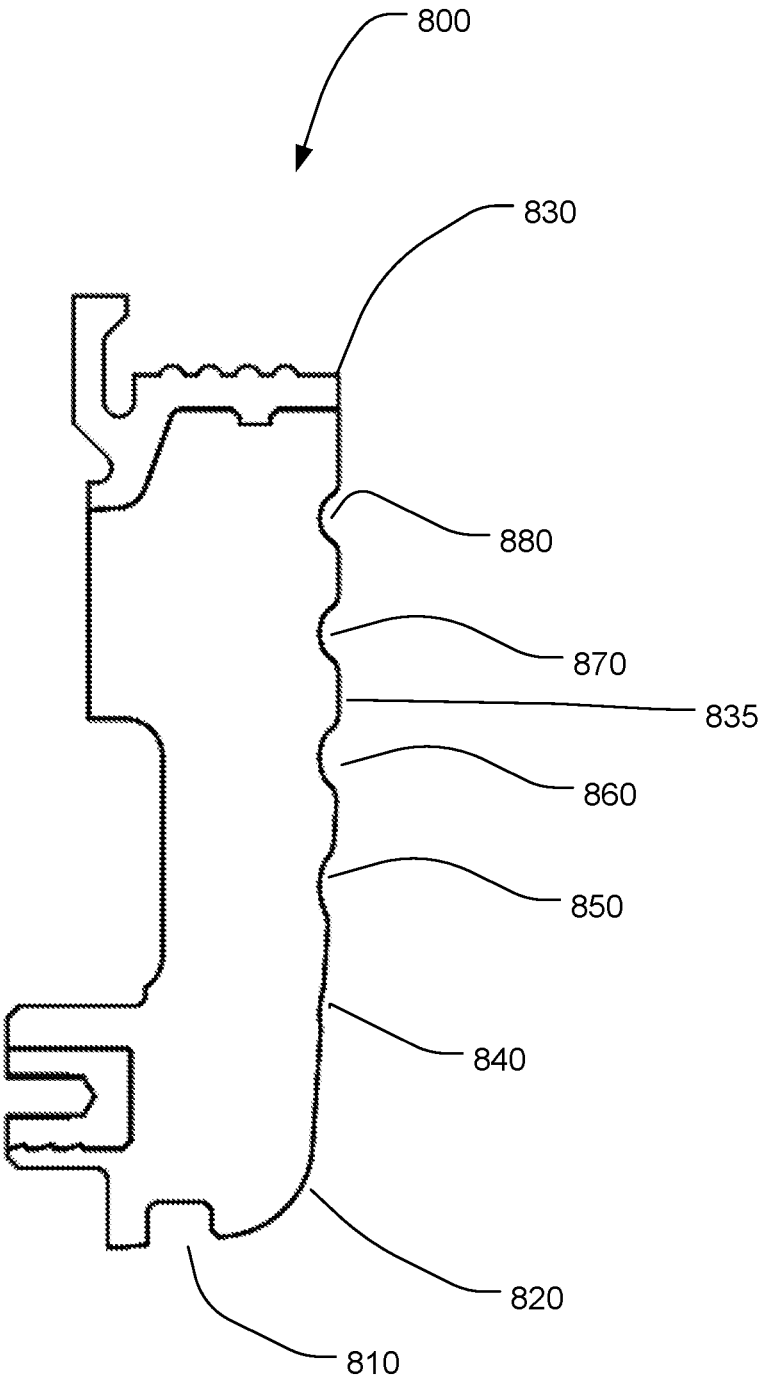
FIG. 8 illustrates a cross section of the side liner of FIG. 6A.

A cross section of a side liner will now be described in relation to side liner 800 of FIG. 8. The side liner 800 has an aperture 810 and an inner edge 820 and an outer edge 830 of a surface 835. Grooves are recessed into the surface 835. As the grooves have a curved shape, the cross section of the side liner 800 shows more than one groove, with the grooves meeting the cross section at different angles. An inner edge groove 840 is shown with a shallow cross section as the grooves on the surface 835 are shallowest near the inner edge 820 and the outer edge 830. Depth of the grooves increases towards a mid-point of the surface 835, as can be seen in groove 850, groove 860, groove 870 and groove 880. A shape of the grooves in FIG. 8 vary as the angle the groove meets the cross section varies. As a result, the groove 850 is shown with a wider groove cross section than the groove 880. However, all the grooves on the surface 835 may be formed with the same, or a matching, cross section.

Depth profiles for grooves of a side liner will now be described in relation to FIGS. 9A to F. The depth profiles may be used on liners such as side liners 14 and 30, the side liner 600, radial groove side liner 690, angled radial groove side liner 695 and the front side liner 750. A depth profile is the depth of the groove from an inner edge of a liner, to an outer edge of a surface of the liner, travelling along the groove. Typically, a deeper groove will last longer as the liner is worn away by the slurry.

Each of the profiles are shown on a graph with a distance from centre axis 910 in the x direction and a depth axis 920 in the y direction. Marked on the distance from centre axis 910 are an inner edge 930 distance from the centre of the surface, a mid-point 940 of the surface and an outer edge 950 of the surface. The depth of a groove is shown from the inner edge 930 to the outer edge 950.

Figure 9A:
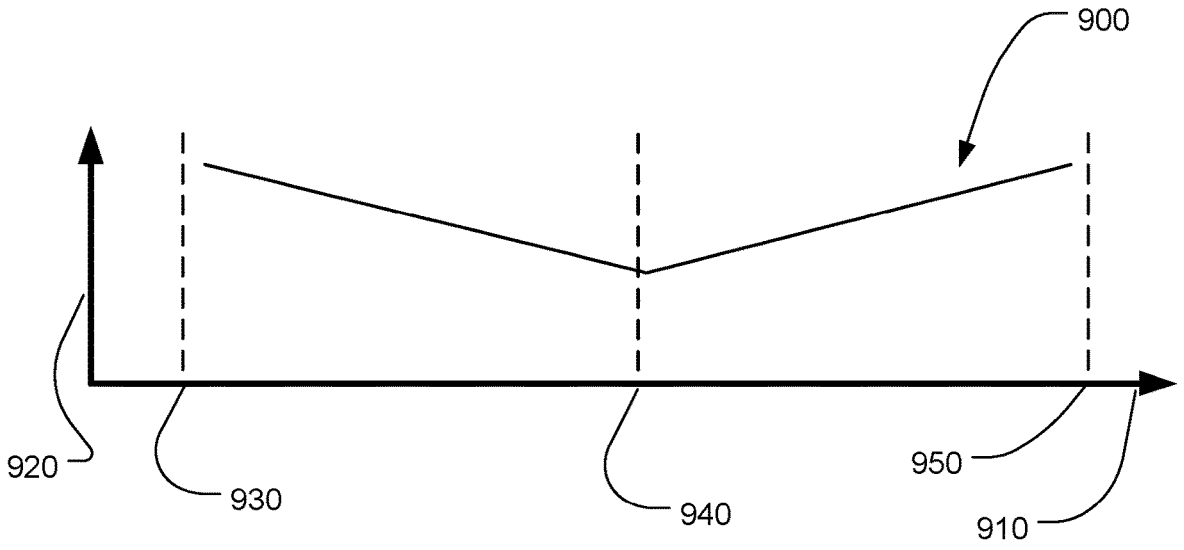
FIGS. 9A to F illustrate depth profiles for a groove of a side liner according to one embodiment.
Figure 9B:
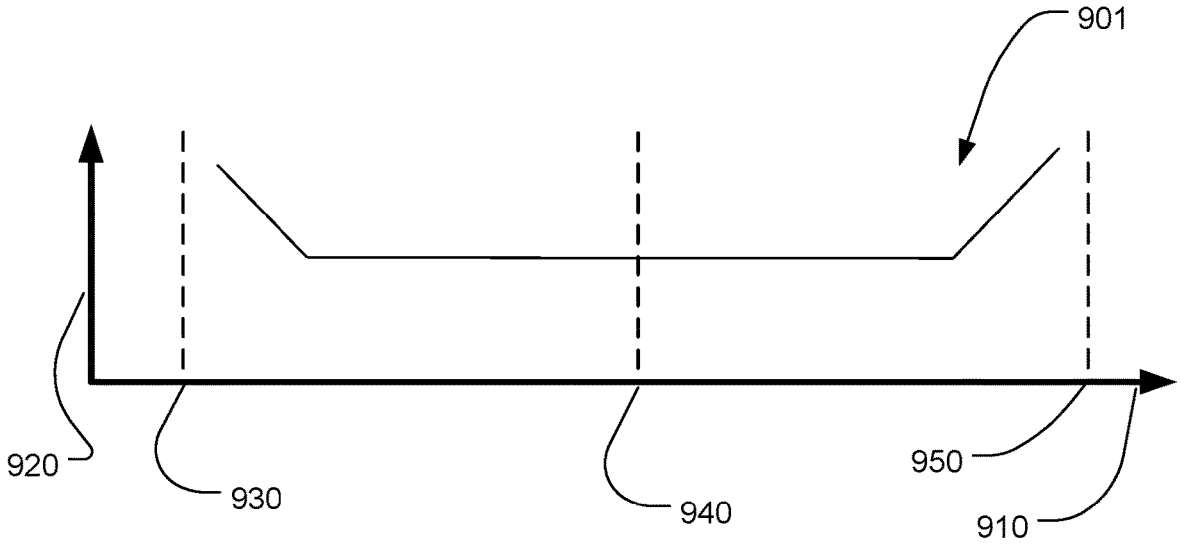

The depth profiles of the grooves may vary in a manner of different ways and the profiles shown in FIGS. 9A to F are six examples where each of the depth profiles are deepest near a mid-point of the surface of the liner. FIG. 9A shows a V shaped profile 900 where the depth of the groove varies in a linear manner from shallow points located near the inner edge 930 and the outer edge 950, to a deepest point located near the mid-point 940. An alternative profile is shown in FIG. 9B where a flat bottom V shaped profile 901 with a deepest part of the depth profile occurs over an extended region of the surface. Such a shape may be varied by changing an extent of the flat portion of the profile or a rate of change of the profile at each end.

Figure 9C:
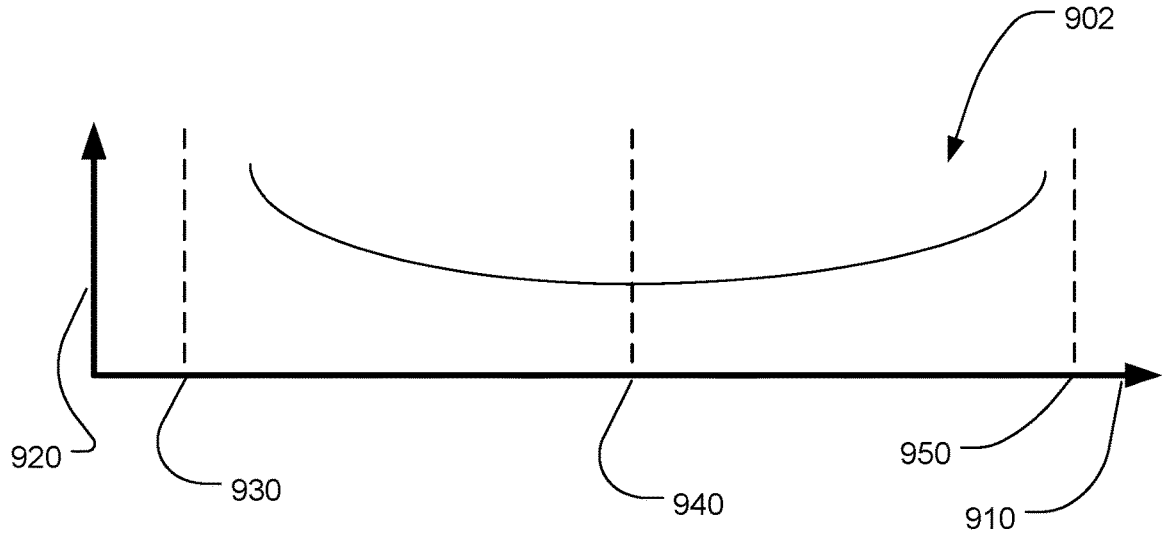
Figure 9D:
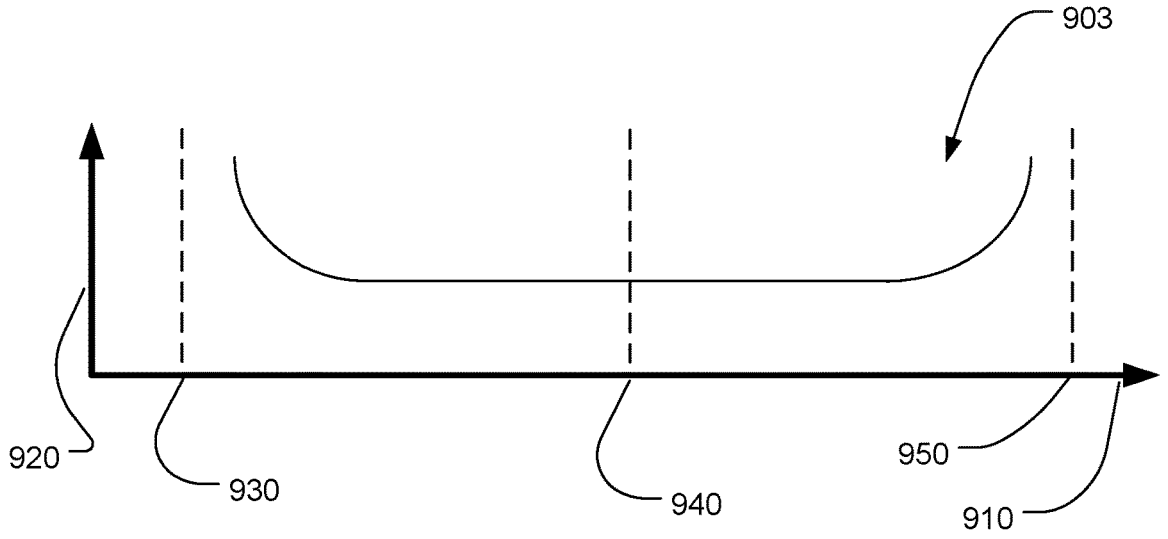

FIG. 9C shows a continuously curved U shaped profile 902 with a deepest part of the groove occurring near the mid-point 940 and the groove being shallowest near the inner edge 930 and the outer edge 950. Various aspect of the curve may be modified and varied such as "flatness" of the bottom of the curved U profile 902, initial slope near the inner edge 930 and the outer edge 950, or the rate of change of the curved U profile 902. FIG. 9D shows a flat bottom U profile 903 which may be considered to have a flat bottom, similar to the flat bottom V shaped profile 901, but with curved side profile similar to the curved U profile 902. As with the flat bottom V shaped profile 901 and the curved U profile 902, aspects of the flat bottom U profile 903 may be varied, such as a size of the flat portion or an initial slope of the depth profile near the inner edge 930 and the outer edge 950.

Figure 9E:
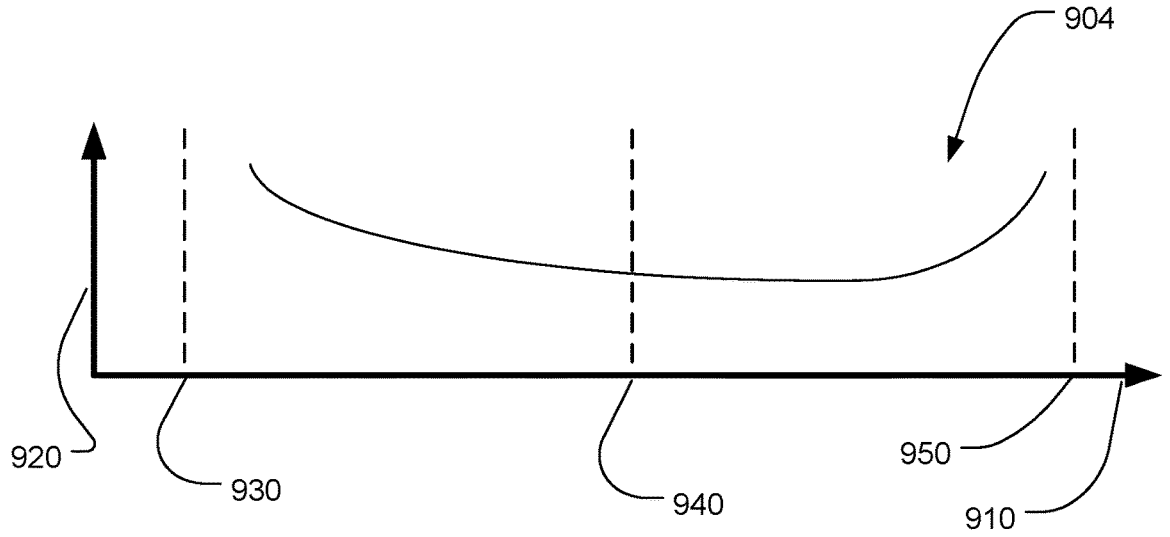
Figure 9F:
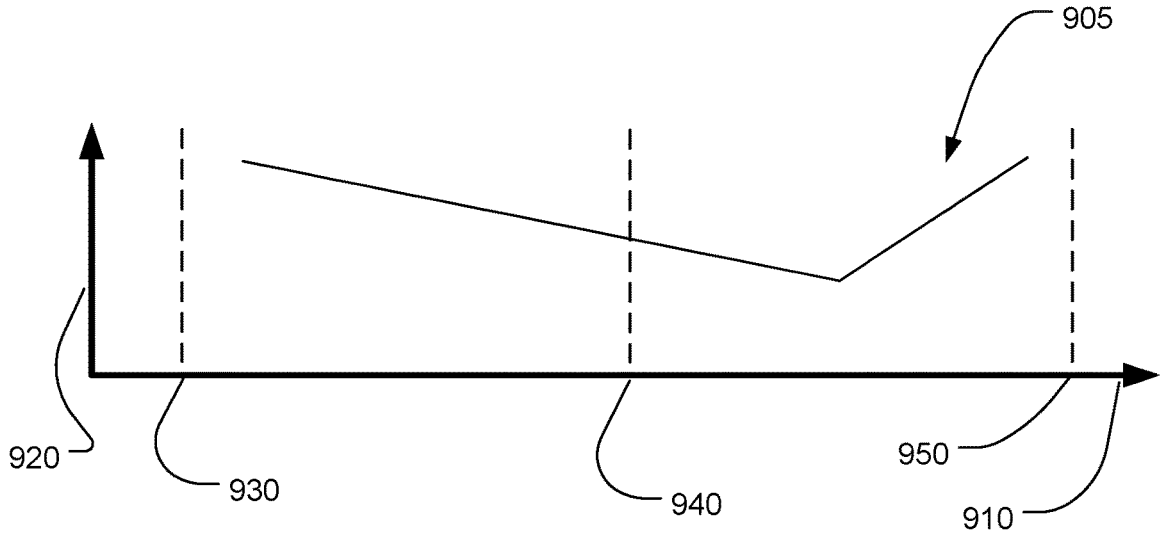

An alternative depth profile may have the depth of the groove decrease only towards an inner edge or towards only an outer edge of the surface of the liner. Such a profile may be referred to as a J profile. An example of such a profile is shown in FIG. 9E which shows a curved asymmetric profile 904 with a deepest part of the groove located between the mid-point 940 and the outer edge 950. While the curved asymmetric profile 904 has a curved profile, other profiles are also possible. FIG. 9F shows a straight asymmetric profile 905 with a deepest part of the groove located between the mid-point 940 and the outer edge 950. While the curved asymmetric profile 904 and the straight asymmetric profile 905 have a deepest part of the groove located towards the outer edge 950, in one alternative the deepest part of the groove may be located closer to the inner edge 930.

The depth of the grooves may have an average of 2, 3, 4, 5, 6, 7, 8, 9, 10, 11, 12, 13, 14, 15, 16, 17, 18, 19, 20, 25, 30, 35, 40, 45 or 50 millimetres. The maximum depth of the grooves may be any one of 1, 2, 3, 4, 5, 6, 7, 8, 9, 10, 11, 12, 13, 14, 15, 16, 17, 18, 19, 20, 25, 30, 35, 40, 45 or 50 millimetres. The groove depth may have an average depth of at least 10 mm, at least 20 mm, at least 30 mm, at least 40 mm or at least 50 mm. Due to the abrasive nature of slurry, the groove depth should be deep enough that the grooves are not worn too quickly. The average groove depth may also be expressed as a percentage of a thickness of the liner, such as 5%, 6%, 7%, 8%, 9%, 10%, 11%, 12%, 13%, 14%, 15%, 16%, 17%, 18%, 19% or 20%. Alternatively, the average groove depth as a percentage of the thickness of the liner may be expressed as a range, such as 11% to 16%, 10% to 17% or 10% to 20% The groove width may be an average of at least 10 mm, at least 20 mm, at least 30 mm, at least 40 mm or at least 50 mm.

Example groove cross sections will now be described in relation to FIGS. 10A to E. The groove cross sections represent a shape of the groove cut or cast into the surface of the liner and are seen in a cross section perpendicular to the depth profiles discussed above in relation to FIGS. 9A to D. The grooves may be formed in a liner as part of the mould used to create the liner, or may be cut into the surface of the liner after the liner has been cast. Typically, grooves on a side liner will have the same, or matching, cross sections.

Figure 10A:
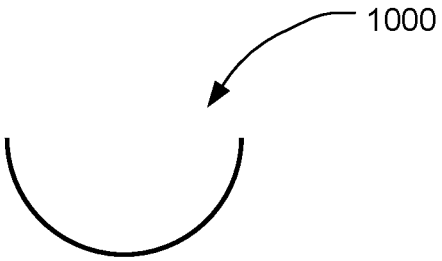
FIGS. 10A to E illustrate groove cross sections for a groove of a side liner according to one embodiment.
Figure 10B:
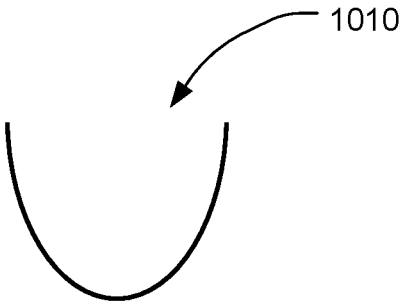
Figure 10C:
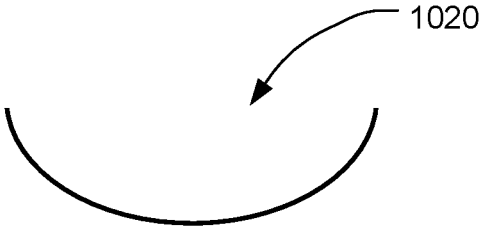
Figure 10D:
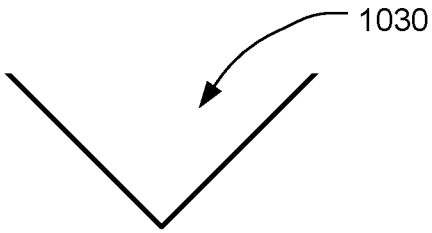
Figure 10E:
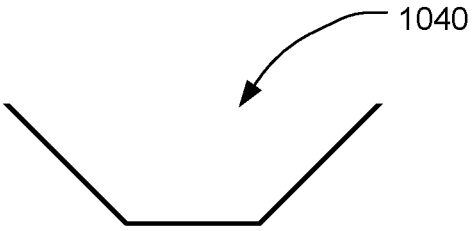

FIG. 10A shows a semi-circular profile 1000. A radius of the semi-circular profile 1000 may be 5, 6, 6.5, 7, 7.5, 8, 8.5, 9, 10, 11, 12, 13, 14, 15, 16, 17, 18, 19 or 20 millimetres. The radius of the semi-circular profile 1000 may also be expressed as a percentage of a thickness of the liner, such as 5%, 6%, 7%, 8%, 9%, 10%, 11%, 12%, 13%, 14%, 15%, 16%, 17%, 18%, 19% or 20%. The radius of the semi-circular profile 1000 to the thickness of the liner percentage may be expressed as a range, such as 11% to 16%, 10% to 17% or 10% to 20%. In one example the radius of the semi-circular profile 1000 is constant while a depth of the groove varies. Alternatively, the radius of the semi-circular profile 1000 may vary over the length of the groove with the values listed above being used for a deepest part of the groove. FIG. 10B shows a narrow semi-elliptical profile 1010 which is deeper than it is wide. Such a profile may be used when a depth of the groove is to be deeper than the width of the groove. The opposite of the narrow semi-elliptical profile 1010 is a wide semi-elliptical profile 1020 shown in FIG. 10C. Such a profile is useful when a relatively shallow groove is required.

Profiles with straight edges may also be used. An example is V shaped profile 1030 of FIG. 10D or a flat bottom V shaped profile 1040 of FIG. 10E. Such profiles have an advantage over curved groove cross sections as an angle between the surface of the liner and the groove is constant until the groove is worn away. The angle between the surface and the groove will vary for a curved profile as the surface of the liner is worn away.

The angle between the groove and the surface of the liner may be important to ensure correct operation of a patterned side liner. When in operation, the grooves of the side liner may make flow of the slurry turbulent over a region of the side liner surface. The turbulent flow may prevent gouging of the side liner by slowing the slurry down and dissipating energy from the flow of slurry. As a result, a very shallow angle between the grooves and the side liner may not induce sufficient turbulence and gouging of the side liner may occur, albeit at a reduced rate compared to flat surfaced liner.

Variations of the above described groove cross sections may also be used. One example is a combination of a flat bottom and a semi-circle, narrow semi-ellipse or a wide semi-ellipse. Grooves may also be positioned next to each other so that two grooves form a larger groove. One example would be two V shaped profiles forming a W shaped profile.

A width of the grooves of the side liner may vary over the surface of the side liner. The groove width, for a groove with any of the profiles discussed above in FIGS. 10A to D, may vary with a depth of the groove. For example, the V shaped profile 1030 will be narrower at a shallow section of the groove and wider for a deeper section of the groove. A similar change in groove width may also occur for the semi-circular profile 1000, the narrow semi-elliptical profile 1010, the wide semi-elliptical profile 1020 and the flat bottom V shaped profile 1040. In some embodiments, the cross section of the groove may be varied to change a width of the groove, while maintaining a constant dept. Such a situation may occur, for example, by varying an angle of the V for the V shaped profile 1030.

While the grooves described in relation to FIG. 6A to C and FIG. 7 are shown with arc shaped or curved grooves, alternative shapes may be used for the groove. In one embodiment, the grooves may be straight and extend radially from the central aperture to the edge of liner. Alternatively, the grooves may be straight, but be at an angle from a radial line. Typically, the grooves will be angled in an opposite direction to the main or auxiliary vanes on the impeller. That is, the grooves are forward-angled when viewed with a direction of rotation of the impeller. Alternatively, straight grooves may be angle in the same direction as the main or auxiliary vanes, if auxiliary vanes are fitted. That is, the grooves are backwards-angled when viewed with a direction of rotation of the impeller. In one alternative, the groove of the front side liner and the back side liner have matching patterns. Alternatively, the groove patterns may be different. For example, the front side liner may have curved grooves in a direction opposite the direction to the main vanes on the impeller while the back side liner may have curved grooves in the same direction as the vanes on the impeller.

Another alternative is to have each of the grooves set out in a plurality of straight segments to approximate a curve. In one example, only two straight segments may be used for a groove, with an angle between the two segments. The angle between the two segments may be set to approximate backwards-curving grooves or forwards-curving grooves. More than two straight segments may also be used. When a curve is approximated by straight line segments the segments may be connected or disconnected. However, as a gap between each straight line segment may increase gouging of the surface of the liner as there is no groove to disrupt flow of the slurry. Grooves with an approximated curve made up of straight lines may be curved in a direction opposite the main or auxiliary vanes of the impeller or curved in the same direction as the main or auxiliary vanes of the impeller. That is, the grooves may be backwards-curving when viewed with a direction of rotation of the impeller, or forwards-curving.

A shape of the arcs, or curvature, of the grooves may also be varied. In one embodiment, the curvature may be similar, or substantially similar, to curvature of the main vanes of the impeller. Alternatively, the curvature of the grooves may match a curvature of auxiliary vanes on the impeller. Another alternative for the curvature of the groove may be a curvature unrelated to any of the vanes on the impeller. Instead, the curvature may be selected based on an intended speed of the impeller. For example, a slow impeller speed may have grooves with less curvature than a faster impeller speed, or vice versa.

Simulation results showing speed of a material, such as slurry, flowing over a pump liner will now be described in relation to FIGS. 11A to D. Each of the figures shows a pump liner with a back side liner and a portion of a main liner with different designs for the back side liners. The impeller of the pump used in the simulations does not have auxiliary vanes fitted.

Figure 11A:
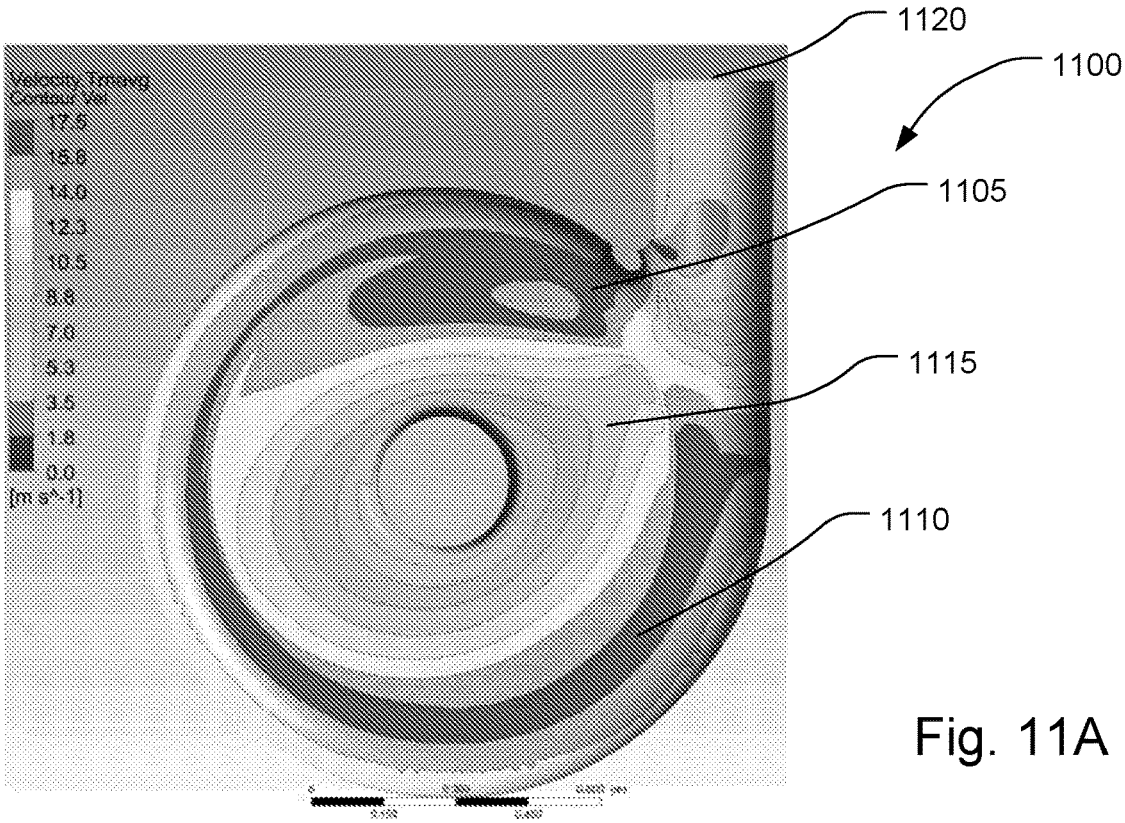
FIGS. 11A to D illustrate slurry velocity on a pump liner according to at least one embodiment.

FIG. 11A shows a pump liner 1100 with a flat back side liner. The pump liner has a main liner, high velocity region 1105 near a cutwater of the main liner. The high velocity region extends from the main liner and onto a surface of the side liner. A side liner medium velocity region 1115 covers a large portion of the side liner with a main liner high velocity region 1110 shown where slurry moves around the main liner, towards the outlet 1120.

Figure 11B:
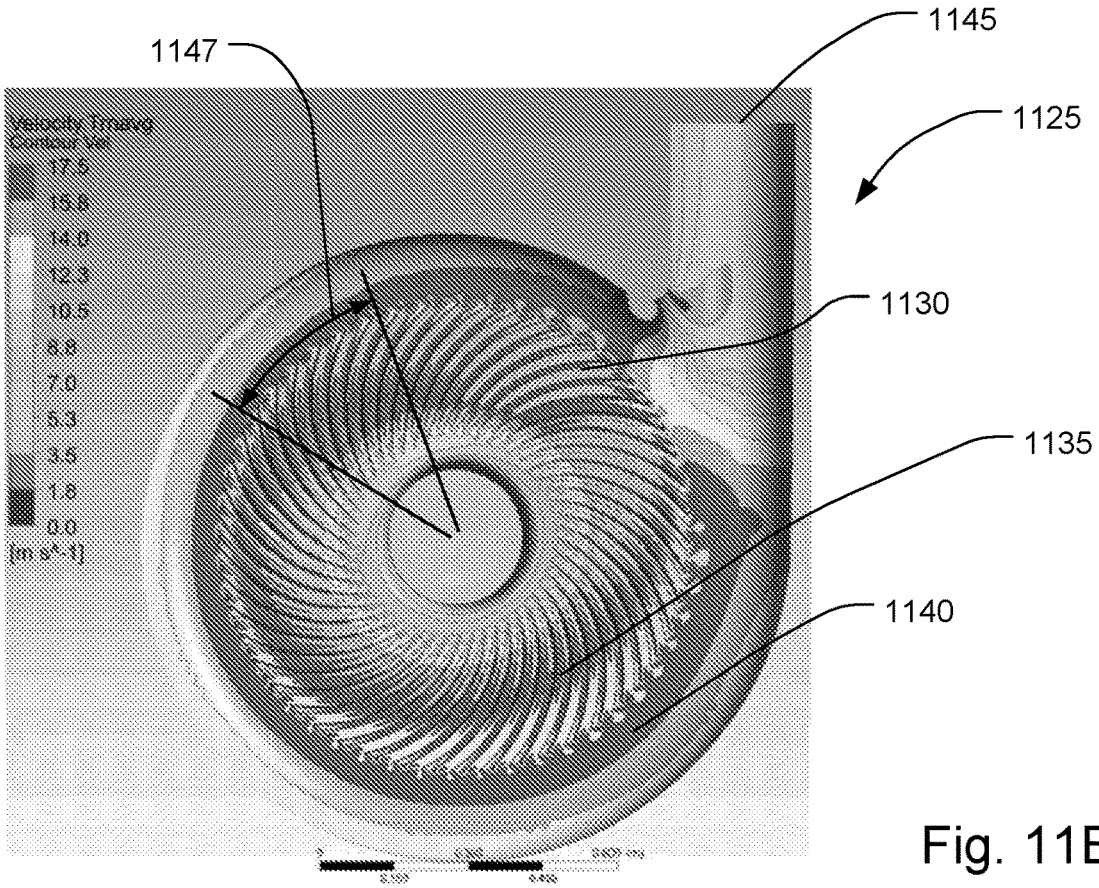

FIG. 11B shows a pump liner 1125 with a backwards-curving back side liner. Grooves on the back side liner are curved in the same direction as the vanes on the impeller. A side liner mixed velocity region 1130 is located near the cutwater of the main liner and shows regions of high velocity slurry as well as lower velocity regions. The surface of the side liner has many regions of high velocity slurry contact, such as side liner high velocity region 1135. The pump liner also has a main liner high velocity region 1140 leading to outlet 1145. Due to the curve of the grooves on the back side liner, the grooves have a groove angle 1147 which is an angle between a start of the groove to an end of the groove, when measured from the centre of the liner. The groove angle 1147 is marked from one end of the groove at an inner edge, to the other end of the groove at the outer end. The grooves of the pump liner 1125 all have the same groove angle of approximately 40 degrees for each of the 50 grooves.

Figure 11C:
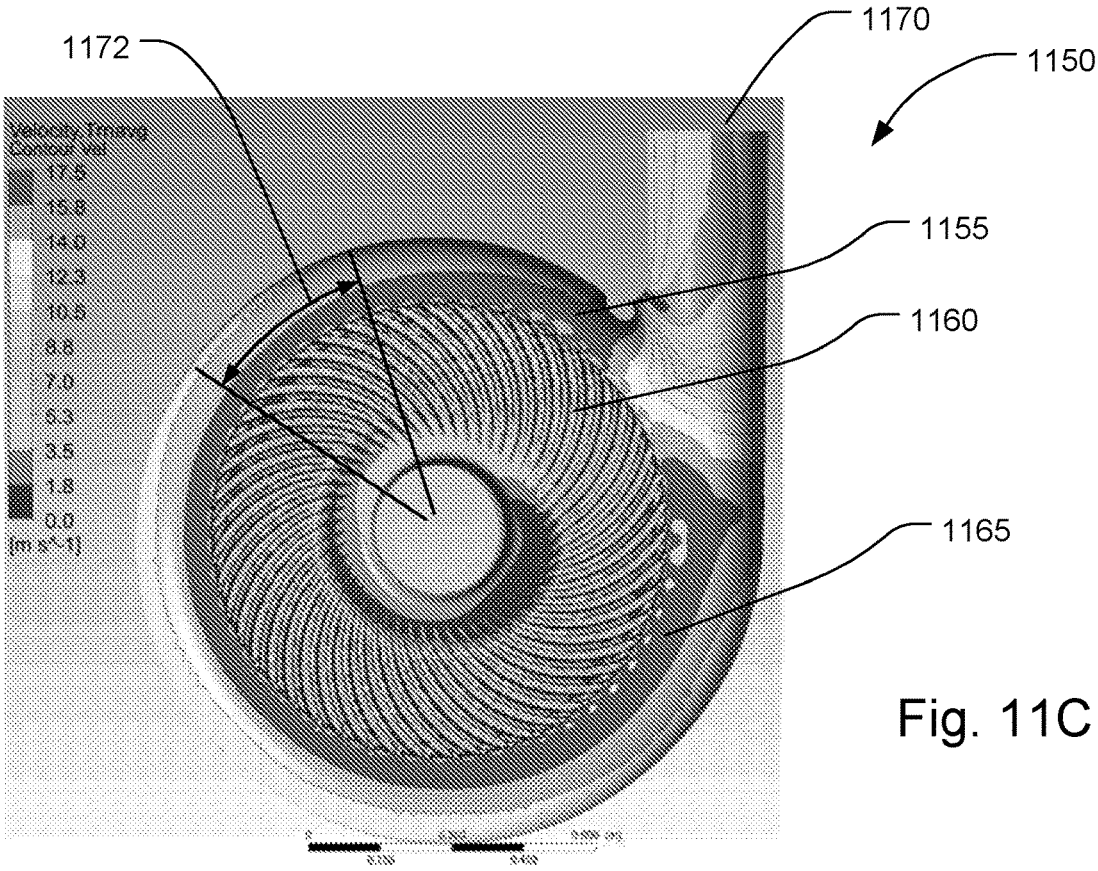

FIG. 11C shows a pump liner 1150 with a forwards-curving back side liner. Grooves on the back side liner are curved in the opposite direction to the vanes on the impeller. A main liner high velocity region 1155 is located near the cutwater of the main liner, however a side liner mixed velocity region 1160 has regions of low and middle velocities showing an effect of the grooves on the velocity of the slurry on the surface of the side liner. The velocity of the slurry is lower over the grooved surface of the side liner than adjacent regions of the main liner. As with the pump liner 1100 and the pump liner 1125, there is a main liner high velocity region 1165 leading towards an outlet 1170. As the grooves on the back side liner are curved, the grooves have a groove angle 1172, similar to the groove angle 1147. The grooves of the pump liner 1150 all have the same groove angle of approximately 40 degrees for each of the 50 grooves. In one example, the groove angle 1172 may be a negative angle, in contrast to the positive groove angle 1147. A front side line with grooves may also have a groove angle.

Figure 11D:
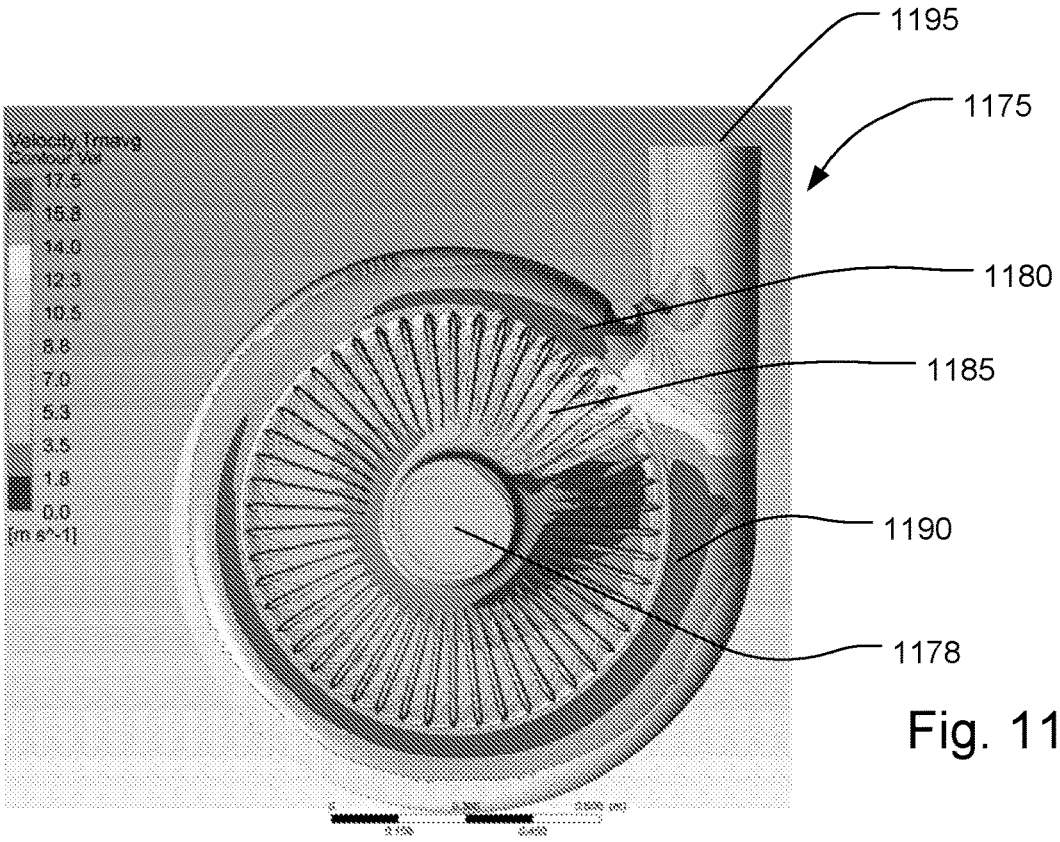

FIG. 11D shows a pump liner 1175 with a straight radial back side liner. Grooves on the back side liner are straight and extend straight radially from near an aperture 1178. A main liner high velocity region 1180 is located near the cutwater of the main liner, however velocity of the slurry on the surface of the liner is generally low with the highest velocity on the surface of the side liner being a side liner medium velocity region 1185 located near the main liner high velocity region 1180. As seen with the other main liners, there is a main liner high velocity region 1190 leading toward an outlet 1195. The pump liner 1175 has a zero degree groove angle as the grooves start and finish at the same angle from a centre of the pump liner 1175.

The grooves described above have a groove angle of approximately 40 degrees. Other angles are also possible, such as 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175 and 180. The grooves may also be in ranges, such as 10-45, 10-90, 20-45, 20-90, 30-45, 30-90, 40-45, 40-90, 50-90, 60-90 and 70-90. The number of grooves on a liner may be 5, 10, 15, 20, 25, 30, 35, 40, 45, 50, 55, 60, 65, 70, 75, 80, 85, 90, 95, 100, 105, 110, 115, 120, 125, 130, 135, 140, 145 or 150. Alternatively, the number of grooves may be expressed as a range, such as 10-50, 10-80, 20-50, 20-80, 30-50, 30-80, 40-50, 40-80, 50-80, 60-80 or 70-80. Alternatively, the number of grooves may be expressed as greater than four, greater than eight, greater than 16 grooves or greater than 32 grooves. The number of grooves may also be less than 100, less than 90, less than 80, less than 70, less than 60 or less than 50. The grooves may also be in any combination of the ranges listed, for example, greater than 4 and less than 100, greater than 8 and less than 100, or greater than 8 and less than 90.

Figure 12:
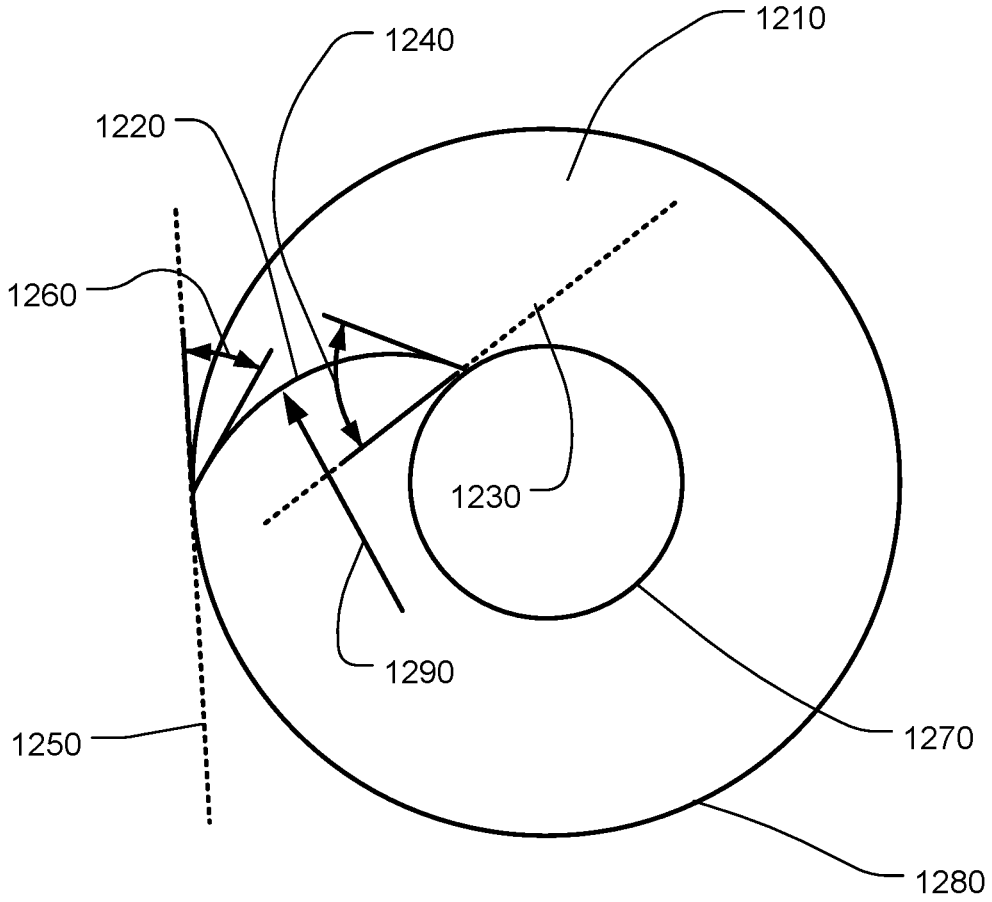
FIG. 12 illustrates a groove of a side liner according to one embodiment.

FIG. 12 shows a side liner 1210 with a groove 1220. The groove 1220 extends from an inner edge 1270 to an outer edge 1280. The groove 1220 has an inner edge angle 1240 that is an angle between the groove 1220 and an inner edge tangent 1230 where the groove 1220 touches the inner edge 1270. The groove 1220 also has an outer edge groove angle 1260 that is an angle between the groove 1220 and an outer edge tangent 1250 where the groove 1220 touches the outer edge 1280. The inner edge groove angle 1240 may be 0, 5, 10, 15, 20, 25, 30, 35, 40, 45, 50, 55, 60, 65, 70, 75, 80, 85 or 90 degrees. Similarly, the outer edge groove angle 1260 may be 0, 5, 10, 15, 20, 25, 30, 35, 40, 45, 50, 55, 60, 65, 70, 75, 80, 85 or 90 degrees. Each of the grooves of the side liner 1210 has a groove curvature radius 1290. The groove curvature radius 1290 may vary along the groove and the groove curvature radius 1290 may be measured at a centreline path, where the centreline path is a middle of the grooves between the inner edge 1270 and the outer edge 1280. The size of the groove curvature radius 1290 may vary based on a size of the side liner 1210, with a larger side liner 1210 having a larger groove curvature radius 1290. The groove curvature radius 1290 may be expressed as a percentage of the outer diameter of the side liner 1210 and may be 25%, 26%, 27%, 28%, 29%, 30%, 31%, 32%, 33%, 34% or 35%. The groove curvature radius 1290 as a percentage of the outer diameter may also be expressed as a range, such as 30% to 32%, 25% to 35%, 30% to 40% or 25% to 40%.

While the grooves described above have been recessed into a surface of a liner, alternative liners may have the grooves protruding from the surface of the liner. Protruding grooves may also have similar properties as the recessed grooves, such as the protruding distance of the groove may vary over the liner surface. The protruding grooves may also have a protruding distance profile, similar to the depth profile of the recessed grooves. A cross section of the protruding groove cross section may also vary and be shapes such as square, rectangular, rounded square, rounded rectangle, semi-circular, semi-elliptical, V shaped, flattened semi-circular, flattened semi-elliptical, flattened V shaped, W shaped or some other shape, including a possible combination of the above cross sections.

One problem that may occur when using protruding grooves is that the grooves may wear away leaving flat regions of the liner surface. The flat surface may then suffer from gouging. To overcome such a problem, the surface of the liner may use a combination of recessed and protruding grooves, for example with the recesses and protruding grooves alternating. Once the protruding grooves are worn away, the recessed grooves will continue to provide benefits as described.

In one example, the grooves described above may have a varying curvature or radius. The radius of the grooves may vary between the inner edge and the outer edge. In one example, the radius of the grooves may vary gradually between the inner edge and the outer edge with the radius increasing or decreasing. In another example, the radius of the grooves may be modified in one or more discrete steps between the inner and the outer edge. In another example, the grooves may have a constant radius.

Advantages

As described above, one advantage of a patterned or grooved side liner is that localised wear, or gouging, may be reduced compared to a flat side liner. In particular, a side liner with arc shaped grooves, curving in a direction opposite to main vanes of an impeller, may reduce gouging compared to a flat surfaced side liner. The reduction in gouging may provide extended run time for the centrifugal pump between maintenance shutdowns for replacement or even checking of wear of the side liner. The decreased maintenance requirements may result in lower running costs of the centrifugal pump as operational lifespan of the side liners may be increased. Increased availability of the centrifugal pump may also be possible.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

The invention claimed is:

1. A side liner for a centrifugal slurry pump having main pumping vanes, the side liner comprising:

a centrally located aperture;

at least four grooves to disrupt flow of a mineral slurry on a surface contacting the mineral slurry pumped by the centrifugal slurry pump, each groove of the at least four grooves being an arc extending radially from an inner edge of the surface, located near the aperture, to an outer edge of the surface, and having a start and end between the inner edge and the outer edge, wherein the at least four grooves includes recessed grooves and protruding grooves.

2. The side liner according to claim 1, wherein the curvature of the arc is in a parallel plane of the surface.

3. The side liner according to claim 1, wherein each groove has a depth which varies over the surface, and between the inner edge and the outer edge.

4. The side liner according to claim 3, wherein the depth of each of the at least four grooves decreases from a mid-region towards the outer edge.

5. The side liner according to claim 3, wherein the depth of each of the at least four the grooves decreases from a mid-region towards the inner edge.

6. The side liner according to claim 3, wherein the depth of each of the at least four grooves is deepest at a mid-region located between the outer edge and the inner edge of the surface.

7. The side liner according to claim 1, wherein each groove has a width which is larger at a mid-region of each groove located between the outer edge and the inner edge of the surface than the width of each groove at regions closer to the outer edge and inner edge of the surface.

8. The side liner according to claim 1, wherein the side liner is a front side liner.

9. The side liner according to claim 1, wherein the side liner is a back side liner.

10. A centrifugal slurry pump comprising:

main pumping vanes;

a main liner defining a central chamber for housing the pumping vanes, the central chamber further being defined by at least one side liner with an aperture for access to the central chamber, the at least one side liner including at least four grooves to disrupt flow of a mineral slurry on a surface contacting the mineral slurry pumped by the centrifugal slurry pump, the surface facing in towards the central chamber, each groove of the at least four grooves being an arc extending radially from an inner edge of the surface, located near the aperture, to an outer edge of the surface, and having a start and end between the inner edge and the outer edge, wherein the at least four grooves includes recessed grooves and protruding grooves.

11. The centrifugal slurry pump according to claim 10 comprising:

a second side liner comprising:

an aperture for access to the central chamber of the centrifugal slurry pump through the second side liner;

at least four grooves on a surface contacting the mineral slurry pumped by the centrifugal slurry pump, each groove of the at least four grooves being an arc extending radially from an inner edge of the surface, located near the aperture of the second liner, to an outer edge, wherein the at least four grooves includes recessed grooves and protruding grooves.

12. The centrifugal slurry pump according to claim 11, wherein the side liner is a back side liner and the second side liner is a front side liner.

13. The centrifugal slurry pump according to claim 10, wherein the curvature of the arc is in a parallel plane of the surface.

* * * * *